US010549341B2

(12) United States Patent
Ming et al.

(10) Patent No.: US 10,549,341 B2
(45) Date of Patent: Feb. 4, 2020

(54) R, R, C METHOD AND EQUIPMENT FOR CASTING AMORPHOUS, ULTRA-MICROCRYSTALLINE, MICROCRYSTALLINE AND THE LIKE METAL PROFILES

(71) Applicants: Zhuwen Ming, Guangzhou (CN); Huirong Luo, Guangzhou (CN); Weigang Ming, Guangzhou (CN)

(72) Inventors: Zhuwen Ming, Guangzhou (CN); Huirong Luo, Guangzhou (CN); Weigang Ming, Guangzhou (CN)

( * ) Notice: Subject to any disclaimer, the term of this patent is extended or adjusted under 35 U.S.C. 154(b) by 654 days.

(21) Appl. No.: 15/332,360

(22) Filed: Oct. 24, 2016

(65) Prior Publication Data

US 2017/0106436 A1 Apr. 20, 2017

Related U.S. Application Data

(63) Continuation-in-part of application No. PCT/CN2015/077220, filed on Apr. 22, 2015.

(30) Foreign Application Priority Data

Apr. 23, 2014 (CN) ..... 2014 1 0165617

(51) Int. Cl.

| | |
|---|---|
| ***B22D 11/112*** | (2006.01) |
| ***B22D 11/06*** | (2006.01) |
| ***B22D 11/124*** | (2006.01) |
| ***B22D 11/126*** | (2006.01) |
| ***B22D 11/128*** | (2006.01) |
| ***C21C 7/00*** | (2006.01) |

(52) U.S. Cl.

CPC ..... *B22D 11/112* (2013.01); *B22D 11/0631* (2013.01); *B22D 11/126* (2013.01); *B22D 11/1245* (2013.01); *B22D 11/1246* (2013.01); *B22D 11/1284* (2013.01); *B22D 11/1287* (2013.01); *C21C 7/00* (2013.01)

(58) Field of Classification Search

CPC ..... B22D 11/112; B22D 11/0631

USPC ..... 148/503

See application file for complete search history.

(56) References Cited

U.S. PATENT DOCUMENTS 4,590,988 A 5/1986 Fukuoka et al.

FOREIGN PATENT DOCUMENTS

| | | | |
|---|---|---|---|
| CN | 5316879 | A | 5/1980 |
| CN | 1691994 | A | 11/2005 |
| CN | 101081429 | A | 12/2007 |
| CN | 101332504 | A | 12/2008 |
| CN | 101081429 | B | 9/2012 |
| CN | 103894569 | A | 7/2014 |

OTHER PUBLICATIONS

International Search Report PCT/CN2015/077220; International Filing Date: Apr. 22, 2015; 2 Pgs.

*Primary Examiner* — Weiping Zhu

(74) *Attorney, Agent, or Firm* — Schmeiser, Olsen & Watts, LLP

(57) ABSTRACT

An R, R, C method and equipment for continuously casting amorphous, ultra-microcrystalline, microcrystalline and the like, metal profiles is provided. A working chamber of an exhaust hood with a powerful exhaust hood, and a working cold source of liquid nitrogen at a temperature of t=−190° C. and a pressure of p=1.877 bar are used. The working chamber of exhaust hood is located at the outlet of hot mold, and only air is contained therein in addition to slabs or profiles that are pulled out, without any device or equipment. A traction mechanism pulls metal slabs or profiles out from the outlet of cross section of hot mold. A liquid nitrogen ejector ejects liquid nitrogen to the metal slabs or profiles of different brands and specifications at a liquid nitrogen ejection volume of liquid nitrogen V, an ejection speed of liquid nitrogen K and a thickness of liquid nitrogen ejection layer h.

18 Claims, 2 Drawing Sheets

R, R, C METHOD AND EQUIPMENT FOR CASTING AMORPHOUS, ULTRA-MICROCRYSTALLINE, MICROCRYSTALLINE AND THE LIKE METAL PROFILES

CROSS-REFERENCE TO RELATED APPLICATIONS

This application is a continuation-in-part application to PCT/CN2015/077220, having a filing date of Apr. 22, 2015, based on CN 2014 1016 5617.9, having a filing date of Apr. 23, 2014, the entire contents of which are hereby incorporated by reference.

FIELD OF TECHNOLOGY

The following relates to producing amorphous, ultra-microcrystalline microcrystalline and crystallite structure of ferrous and non-ferrous metals by using the technique of rapid solidification, the technique of air pumping cover working chamber, high ejection speed of low temperature liquid nitrogen, an extremely thin liquid film ejection, and the technique of continuous casting.

BACKGROUND

Embodiments of the invention are developed from Chinese patent application No. of 200410002605.0 and title of "L, R, C method and device for casting amorphous, ultra-microcrystalline, microcrystalline and the like metal profiles" (hereinafter referred to as patent L, the following specification of patent L refers to the specification of the invention with publication No. of CN101081429B), and it's the further improvement of patent L which is hereby incorporated by reference. The embodiments of the present invention are more mature and advanced, with simpler equipment, cheaper cost and better product performance compared to patent L.

The first "R"—represents room temperature. "R" is the first capital letter of room temperature.

The second "R"—represents rapid solidification. "R" is the first capital letter of rapid solidification.

"C"—represents continuous casting. "C" is the first capital letter of continuous casting.

The operating parameters of the embodiments of the present invention and the patent L are both with a temperature of t=−190° C., a pressure of p=1.877 bar, a thickness of liquid nitrogen spray h=2 mm, a maximum liquid nitrogen ejection speed of $k_{max}$=30 m/s. The operating parameters of working chamber of patent L is at a constant temperature of $t_b$=−190° C. and at a constant pressure of $p_b$=1 bar. The temperatures "t" of liquid nitrogen ejected and "$t_b$" of working chamber are both −190° C. in order to avoid the heat exchange among air in working chamber, equipment and liquid nitrogen ejected because all the temperatures of them are −190° C. when liquid nitrogen ejected to small length metal slab Δm of solidified and cool casted amorphous, ultra-microcrystalline, microcrystalline pulled from the outlet of hot casting mold, and the ejected liquid nitrogen comes into contact with the small length metal slab at cross section (the cross section C shown in FIG. 4). In the time interval Δτ corresponding to the different rapid solidification and cooling rate $V_k$ in getting amorphous, ultra-microcrystalline, microcrystalline, the heat exchange only occurs between the ejected liquid nitrogen and the heat conducted from the liquid metal end of small length metal slab Δm to the cross section (the cross section C shown in FIG. 4) of ejected liquid nitrogen and Δm, wherein the heat contains total internal heat of small length metal slab Δm from initial rapid solidification and cooling temperature $t_1$ to ending cooling temperature $t_2$=−190° C. The ejected liquid nitrogen absorbs the heat quickly and completely and gasifies to low temperature nitrogen with a temperature of t=−190° C., a pressure of p=1.877 bar through endothermic gasification phase transition, meanwhile the liquid metal of small length metal slab Δm is solidified rapidly and cool casted to amorphous, ultra-microcrystalline, microcrystalline small length metal slab Δm at an ending cooling temperature of $t_2$=−190° C. Thus the cooling capacity of ejected liquid nitrogen is only used to rapidly solidify and continuously cast amorphous, ultra-microcrystalline, microcrystalline metal profiles without any loss. It ensures the amorphous, ultra-microcrystalline, microcrystalline metal profiles at a temperature of $t_2$=−190° C. can be casted continuously by patent L. But a huge working chamber with a constant temperature $t_b$=−190° C. and constant pressure $p_b$=1 bar is needed. To build a huge working chamber, a low-temperature refrigerator with high-power is needed to keep the temperature of air in working chamber and temperature of device at $t_b$=−190° C. Meanwhile, vacuum and insulation technology are adopted to keep temperature of air in working chamber and temperature of device at $t_b$=−190° C. and constant pressure $p_b$=1 bar. It makes the implementation of patent L carry disadvantages of high cost and great technical difficulty.

But, does the temperature of air in working chamber and temperature of device really need to be at a constant low temperature of $t_b$=−190° C.? How much space is needed in the working chamber? Can the temperature of room air, higher or lower than the temperature of room air be adapted to the temperature of working chamber? The process of endothermic gasification phase transition of small length metal slab Δm pulled from the outlet of hot casting mold and the ejected liquid nitrogen at the cross section C has heretofore not been adequately addressed.

SUMMARY

An aspect relates to providing an R, R, C method and equipment for casting amorphous, ultra-microcrystalline, microcrystalline and the like, metal profiles.

The following is developed from patent L and is the further improvement of patent L. The embodiments of the present invention is more mature and advanced, with simpler equipment, cheaper cost and better product performance compared to patent L.

The first "R"—represents room temperature. "R" is the first capital letter of room temperature.

The second "R"—represents rapid solidification. "R" is the first capital letter of rapid solidification.

"C"—represents continuous casting. "C" is the first capital letter of continuous casting.

BRIEF DESCRIPTION

Some of the embodiments will be described in detail, with reference to the following figures, wherein like designations denote like members, wherein.

DETAILED DESCRIPTION

Figure 1:
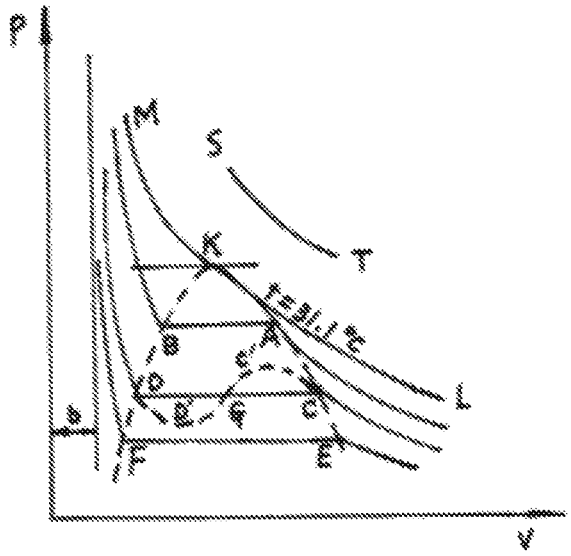
FIG. 1 is an isotherm of carbon dioxide.

1. The Size of Workspace of Working Chamber.

The working principle of the embodiments of the present invention and patent L are both: in the time interval $\Delta\tau$ corresponding to the different cooling rate $V_k$ in getting amorphous, ultra-microcrystalline, microcrystalline, liquid nitrogen is ejected to the cross section (the cross section C shown in FIG. 4) of small length metal slab $\Delta m$ and liquid nitrogen gasified into nitrogen by absorbing the heat conducted from the liquid metal end of small length metal slab $\Delta m$, thus the liquid metal small length metal slab $\Delta m$ is solidified rapidly and cool casted to amorphous, ultra-microcrystalline, microcrystalline metal profiles. The whole rapid solidification and cooling casting process occurs at space of the cross section of ejected liquid nitrogen and small length metal slab $\Delta m$ pulled from the outlet of hot casting mold. Obviously, the space is not big. Provided in Table 3 in specification on pages 26/29 of the patent L, the cooling rate is $V_k=10^{7\circ}$ C./s, $\Delta\tau=1.74\times10^{-4}$ s, $\Delta m=0.03135$ mm when casting 0.23 C amorphous steel slab with width of B=1 m and the maximum thickness of $E_{max}=8.9$ mm. In the time interval $\Delta\tau$ mentioned above, the ejection length of liquid nitrogen on the amorphous steel slab is $L_{d1}$ when liquid nitrogen ejects on each surface of amorphous steel slab at a maximum speed of $K_{max}=30$ m/s.

$$L_{d1}=K_{max}\cdot\Delta\tau=30\times1.74\times10^{-4}\ (\text{m/s})\cdot\text{s}$$

$L_{d1}=5.22$ mm

The liquid steel of small length metal slab $\Delta m$ is solidified and cooled into 0.23 C amorphous steel slab with the maximum thickness of $E_{max}=8.9$ mm when the ejection length of liquid nitrogen is 5.22 mm.

In the patent L, the corresponding ejection length of liquid nitrogen $L_{d2}$ can be calculated using the same calculation method when continuous casting an amorphous steel slab with a width of B=1 m and a thickness of E=5 mm. The ejection lengths of liquid nitrogen $L_{d3}$ and $L_{d4}$ can also be calculated respectively when continuous casting a 0.23 C ultra-microcrystalline steel slab with a width of B=1 m, a maximum thickness of $E_{max}=18$ mm, a width of E=10 mm, $\Delta m=0.0636$ mm, and cooling rate $V_k=2\times10^{6\circ}$ C./s. The ejection lengths of liquid nitrogen $L_{d5}$ and $L_{d6}$ can also be calculated respectively when continuous casting a 0.23 C microcrystalline steel slab (1) with a width of B=1 m, a maximum thickness of $E_{max}=25.5$ mm, a width of E=5 mm, $\Delta m=0.0899$ mm, and cooling rate $V_k=10^{6\circ}$ C./s.

The $L_{d1}$, $L_{d2}$, $L_{d3}$, $L_{d4}$, $L_{d5}$, $L_{d6}$ are as follows:

amorphous steel slab ($V_k=10^{7\circ}$ C./s, $E_{max}=8.9$ mm, E=5 mm)

$L_{d1}=5.22$ mm $L_{d2}=2.94$ mm ultra-microcrystalline steel slab ($V_k=2\times10^{6\circ}$ C./s, $E_{max}=18$ mm, E=10 mm)

$L_{d3}=26.1$ mm $L_{d4}=14.5$ mm microcrystalline steel slab (1) ($V_k=10^{6\circ}$ C./s, $E_{max}=25.5$ mm, E=5 mm)

$L_{d5}=52.2$ mm $L_{d6}=10.2$ mm

It can be concluded that on the basis of the above data, the heat exchange of heat absorption and gasification process of ejected liquid nitrogen only occurs in a small workspace at the outlet of hot casting mold when casting amorphous, ultra-microcrystalline, microcrystalline metal profiles with different brands and specifications. The size of workspace can be initially determined as follows:

width B=1.1 mm, length L=0.1 m, height H=0.1 m.

Although the workspace is very small, the workspace is actually much smaller during heat absorption and gasification process of ejected liquid nitrogen. When liquid nitrogen ejected to the cross section of small length metal slab $\Delta m$ pulled from the outlet of hot casting mold, the ejected liquid nitrogen absorbs heat conducted from the liquid metal end of small length metal slab $\Delta m$ and ejected liquid nitrogen gasifies into low temperature nitrogen with a temperature of t=−190° C. and pressure of p=1.877 bar immediately. The low temperature nitrogen is taken away from the surface of metal slab and exhausted out of working chamber under a powerful exhaust system. It is impossible for ejected liquid nitrogen to move forward on the surface of metal slab and the subsequent ejected liquid nitrogen is gasified and exhausted when arriving at the cross section. Therefore, the ejection length of liquid nitrogen does not exist actually. Given the size of workspace, it is still necessary because an exhaust hood is needed in a powerful exhaust system. The size of exhaust hood can be determined by reference to the size of workspace. Only ejected liquid nitrogen, low temperature nitrogen produced by the heat absorbing and gasifying of ejected liquid nitrogen, amorphous, ultra-microcrystalline, microcrystalline metal slabs pulled and casted from the outlet of hot casting mold and air in the exhaust hood are in the exhaust hood. There are no other equipment and devices being set in the exhaust hood. The ejected liquid nitrogen only exchanges heat with the liquid metal end of small length metal slab $\Delta m$ pulled from the outlet of hot casting mold instead of exchanging heat with the air in the workspace of exhaust hood if some technical measures are adopted in the workspace of exhaust hood. The ejected liquid nitrogen cannot exchange heat with other equipment and devices for no other equipment and devices being set in the exhaust hood. By doing this, the working principle and condition of casting amorphous, ultra-microcrystalline, microcrystalline metal profiles by the heat absorption and gasification of ejected liquid nitrogen of the embodiments of the present invention are consistent with that in patent L which occurs in working chamber. Accordingly, the exhaust hood can replace the huge working chamber with constant temperature and pressure in patent L. The embodiments of the present invention and patent L can both cast continuously qualified amorphous, ultra-microcrystalline, microcrystalline metal profiles with different brands and specifications.

2. Heat Absorption and Gasification Process of Ejected Liquid Nitrogen.

FIG. 1 shows the isotherm of carbon dioxide during the process of heat absorption and gasification of ejected liquid nitrogen. FIG. 1 is the experimental figure of isotherm compression of carbon dioxide. The curve in FIG. 1 is isotherm. K is the critical point, the state of K is critical state, the temperature of K is critical temperature $T_{cr}=31.1°$ C., the pressure of K is critical pressure $p_{cr}$, and the specific volume is critical specific volume $V_{cr}$. The area above the line LKM is gas phase area where carbon dioxide cannot be liquefied.

A gas phase boundary E-C-A-K which is called gas saturation curve is obtained by connecting E, C, A and K. The gas phase of carbon dioxide is on the right of the gas saturation curve. A liquid phase boundary F-D-B-K which is called liquid saturation curve is obtained by connecting F, D, B and K. The liquid phase of carbon dioxide is on the left of the liquid saturation curve. The horizontal line in the saturation curve range of E-C-A-K-B-D-F is the constant temperature and pressure curve of the heat absorption and gasification process of liquid carbon dioxide. These constant temperature and pressure curves exist actually and keep stable when doing experiment on carbon dioxide. Not only with carbon dioxide, but an endothermic effect exists during any liquid gasification process. The heat absorption in the liquid gasification process of liquid mass per unit mass is called latent heat of gasification. The heat absorption and gasification process curve of the ejected liquid nitrogen at the cross section of small length metal slab Δm pulled from the outlet of hot casting mold in the workspace of exhaust hood in the embodiments of the present invention are constant temperature and pressure curve same as the horizontal lines B-A, D-C, F-E in FIG. 1. The heat absorption and gasification process of ejected liquid nitrogen is a continuous phase change process under the situation of a constant temperature and pressure. The produced temperature and pressure of low temperature nitrogen are t=−190° C. and p=1.877 bar. Therefore, the generated low temperature nitrogen in the small workspace of exhaust hood keeps the working condition at a temperature of t=−190° C. and a pressure of p=1.877 bar.

According to the thermophysical properties of liquid nitrogen provided in annex 2 on pages 26/29 of specification of patent L[2], the thermophysical properties of liquid nitrogen at a temperature of t=−190° C. and a pressure of p=1.877 bar are as the table below.

| t ° C. | p bar | V' | V" | $C_p$' | i' | i" | r | s' | s" |
|---|---|---|---|---|---|---|---|---|---|
| −190 | 1.877 | 1.281 | 122.3 | 1.978 | −109.7 | 81.0 | 190.7 | 2.986 | 5.283 |

In the table above:

V'—volume of liquid nitrogen, the volume of 1 Kg liquid nitrogen at t=−190° C. and p=1.877 bar.

V'=1.281 $dm^3$/Kg.

V"—volume of nitrogen produced by the gasification of 1 Kg ejected liquid nitrogen at t=−190° C. and p=1.877 bar.

V"=122.3 $dm^3$/Kg.

r—latent heat of liquid nitrogen, that is heat that 1 Kg ejected liquid nitrogen absorbs at t=−190° C. and p=1.877 bar to gasify into nitrogen.

r=190.7 KJ/Kg.

The Table shows that the volume of 1 Kg liquid nitrogen in the condition of t=−190° C. and p=1.877 bar V' is 1.281 $dm^3$/Kg during the heat absorption and gasification process at the cross section (the cross section C shown in FIG. 4) of small length metal slab Δm pulled from the outlet of hot casting mold. When the liquid nitrogen with a volume of V'=1.281 $dm^3$/Kg absorbs the heat conducted from the liquid metal end of small length metal slab Δm and the latent heat of liquid nitrogen is r=190.7 KJ/Kg, 1 Kg liquid nitrogen becomes low temperature nitrogen with t=−190° C. and p=1.877 bar. The volume of nitrogen produced by the gasification V" is 122.3 $dm^3$, that is the volume of nitrogen produced by the gasification V" is 95.4 times of the volume of ejected liquid nitrogen V'. The working condition of V', V" and r in Table is t=−190° C., p=1.877 bar. The heat absorption and gasification process of ejected liquid nitrogen is the same as the constant temperature and pressure heat absorption and gasification process of liquid carbon dioxide B-A, D-C and F-E shown in FIG. 1. The heat absorption and gasification process of ejected liquid nitrogen in the exhaust hood is a constant temperature and pressure phase change process, and low temperature nitrogen with a temperature of t=−190° C. and a pressure of p=1.877 bar is produced during the process.

Figure 2:
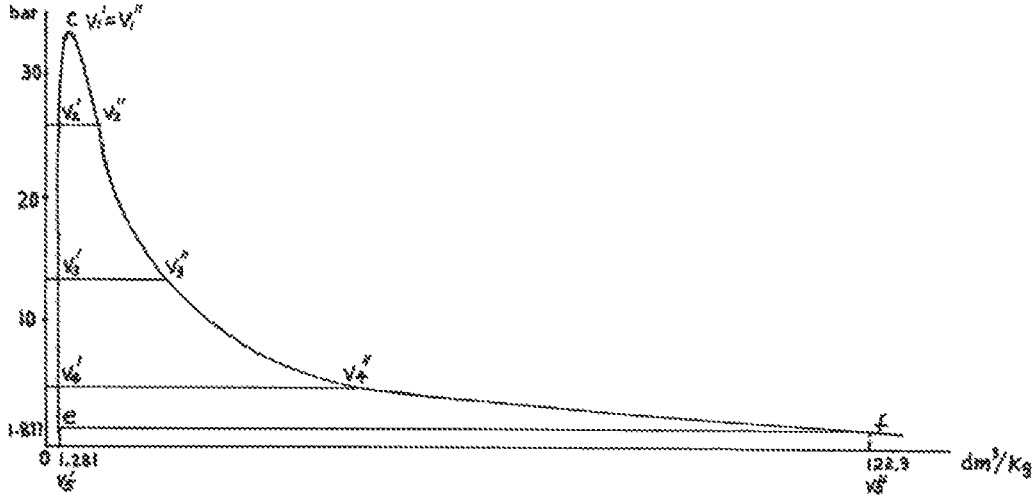
FIG. 2 is a diagram of the process of heat absorption and gasification phase transition of ejected liquid nitrogen drawn according to annex 2 in patent L (shown in specification on pages 26/29)

The thermophysical properties of liquid nitrogen are provided in annex 2 on pages 26/29 of specification of patent L. FIG. 2 is a diagram of the process of heat absorption and gasification of ejected liquid nitrogen pulled from the outlet of hot casting mold of exhaust hood according to the five groups of liquid nitrogen with different temperatures and pressures. The working parameters of three groups are used to analyze the heat absorption and gasification process of ejected liquid nitrogen.

The first group:

$t_1$=−146.9° C., $p_1$=33.96 bar, $V_1'$=$V_1''$=3.289 $dm^3$/Kg, $r_1$=0 KJ/Kg.

The point C is the critical point. C-f is the gas phase boundary (gas saturation curve). C-e is the liquid phase boundary (liquid saturation curve). The area between line C-e and C-f is a liquid-gas coexistence zone which is an area of heat absorption and gasification of liquid nitrogen.

The third group:

$t_3$=−165.16° C., $p_3$=13.03 bar, $V_3'$=1.56 $dm^3$/Kg, $V_3''$=18.22 $dm^3$/Kg, $r_3$=142.8 KJ/Kg.

According to FIG. 2 and above Table, and the definition of horizontal line $V_3'$–$V_3''$ and the latent heat "r", the heat absorption and gasification of ejected liquid nitrogen is a process with constant temperature and pressure. The ejected liquid nitrogen of $V_3'$=1.56 $dm^3$/Kg absorbs a latent heat of $r_3$=142.8 KJ/Kg to produce low temperature nitrogen of $V_3''$=18.2 $dm^3$/Kg with a temperature of $t_3$=−165.16° C. and a pressure of $p_3$=13.03 bar in the condition of $t_3$=−165.16° C., $p_3$=13.03 bar.

The fifth group:

$t_5$=−190.16° C., $p_5$=1.877 bar, $V_5'$=1.281 $dm^3$/Kg, $V_5''$=122.3 $dm^3$/Kg, $r_5$=190.7 KJ/Kg.

The parameters in the fifth group is the working parameters in embodiments of the present invention and patent L.

Figure 3:
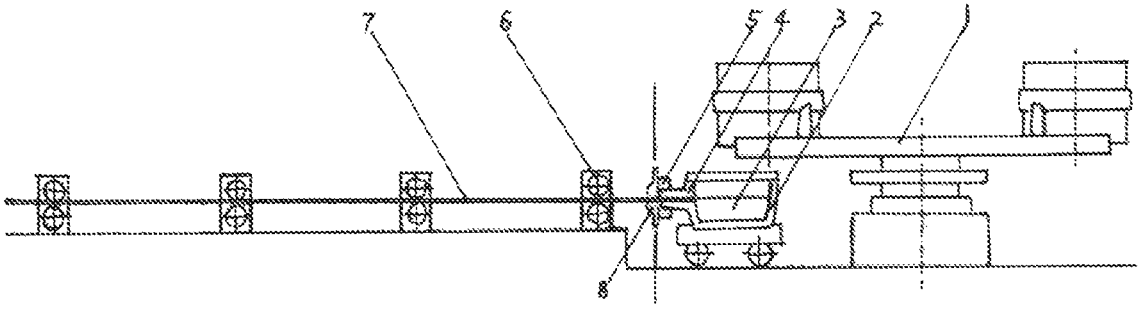
FIG. 3 is a drawing that illustrates the working principle of the continuous casting of amorphous, ultra-microcrystalline, microcrystalline metal profiles in embodiments of the present invention.
Figure 4:
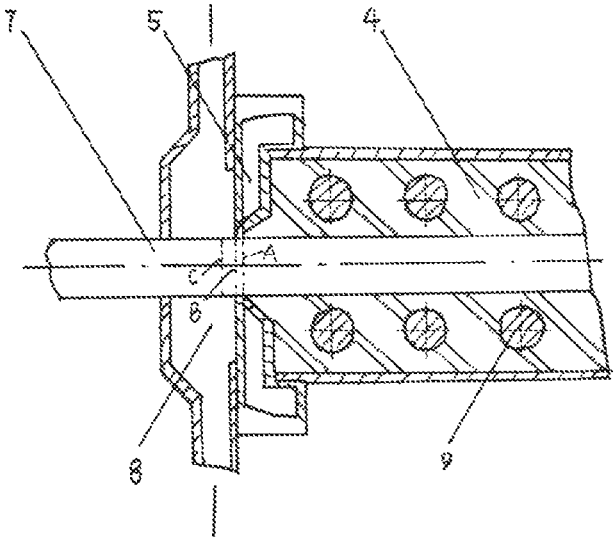
FIG. 4 is a drawing of the rapid solidification and cooling process of liquid metal at the outlet of the hot casting mold.

FIG. 3 is a drawing that illustrates the working principle of the continuous casting of amorphous, ultra-microcrystalline, microcrystalline metal profiles in embodiments of the present invention. FIG. 4 is a drawing of the rapid solidification and cooling process of liquid metal at the outlet of the hot casting mold 4. The names and functions of symbols 1, 2, 3, 4, 5, 6, 7 and 9 are the same as that in patent L. The huge working chamber at constant temperature and pressure marked by symbol 8 in patent L is replaced by working chamber of exhaust hood 8 in embodiments of the present invention. FIG. 4 shows that only amorphous, ultra-microcrystalline, microcrystalline metal slabs 7 casted continuously, air in the workspace of exhaust hood, and low temperature nitrogen produced by the heat absorbing and gasifying of ejected liquid nitrogen at the cross section of small length metal slab Δm (the section spacing of a-c) exit in the working chamber of exhaust hood 8 without any other equipment and devices. The temperature and pressure in working chamber of exhaust hood 8 adopts normal ambient temperature and pressure in embodiments of the present invention rather than the constant temperature and pressure of t=−190° C., p=1 bar in patent L. When liquid nitrogen ejects to the cross section C, the working condition of ejected liquid nitrogen is the state point "e" in FIG. 2 for its working parameters of temperature t=−190° C. and pressure p=1.877 bar. The phase change of heat absorption and gasification of the ejected liquid nitrogen is in accordance with the constant temperature and pressure curve e-f, and ejected liquid nitrogen absorbs heat rapidly from each surface of the cross section with small length metal slab Δm to produce low temperature nitrogen with t=−190° C., p=1.877 bar. A volume of low temperature nitrogen V"=122.3 $dm^3$ is produced when heat of r=190.7 KJ/Kg is absorbed from the liquid metal end of small length metal slab Δm by 1 Kg ejected liquid nitrogen with a volume of V'=1.281 $dm^3$. The volume of V" is 95.4 times of the volume of ejected liquid nitrogen V'. The thickness of low temperature nitrogen layer is 190.8 mm when the thickness of ejected liquid nitrogen layer is h=2 mm. The new produced low temperature nitrogen layer with t=−190° C., p=1.877 bar is located and covered on the ejected liquid nitrogen layer at cross section C, thus separating the ejected liquid nitrogen layer and the air in exhaust hood completely. The pressure of low temperature nitrogen is p=1.877 bar and the pressure of air inside/outside the hood is p=1 bar. The air inside/outside the hood cannot go through the low temperature nitrogen. So it is impossible for the heat exchange between the air inside/outside the hood and ejected liquid nitrogen. The ejected liquid nitrogen cannot exchange heat with other equipment for no other equipment being set in the exhaust hood. The ejected liquid nitrogen cannot exchange heat with low temperature nitrogen because the temperatures of ejected liquid nitrogen and low temperature nitrogen produced by the heat absorption and gasification ejected liquid nitrogen are both −190° C. In all, the ejected liquid nitrogen can only exchange heat with the heat of cross section C conducted from liquid metal end of small length metal slab Δm. It ensures the cooling capacity of ejected liquid nitrogen is completely used to continuously cast amorphous, ultra-microcrystalline, microcrystalline metal profiles without any loss. It fulfills the requirement that the ejected liquid nitrogen only exchanges heat with the small length metal slab Δm.

The amorphous, ultra-microcrystalline, microcrystalline metal profiles at the temperature of $t_2$=−190° C. can be casted continuously by patent L. The working principle and condition of casting amorphous, ultra-microcrystalline, microcrystalline metal profiles in embodiments of the present invention are consistent with that in patent L.

When casting 0.23 C amorphous, ultra-microcrystalline, microcrystalline small length steel slab Δm with maximum thickness $E_{max}$ or thickness E, in time interval Δτ corresponding to the different rapid solidification and cooling rate $V_k$, liquid nitrogen ejector 5 ejects liquid nitrogen at corresponding temperature and pressure of t=−190° C., p=1.877 bar with a quantity of Vmax or V to the cross section C of small length metal slab Δm in working chamber of exhaust hood. In accordance with the constant temperature and pressure curve e-f, the ejected liquid nitrogen absorbs all the internal heat of the liquid steel of small length steel slab Δm from initial rapid solidification and cooling temperature $t_1$=1550° C. to ending cooling temperature $t_2$=−190° C. Thus producing 0.23 C amorphous, ultra-microcrystalline, microcrystalline small length steel slab Δm with temperature t=−190° C., thickness of $E_{max}$ or E. 0.23 C amorphous, ultra-microcrystalline, microcrystalline metal profiles with different specifications can be casted continuously by repeating the process.

Traction mechanism 6 pulls 0.23 C amorphous, ultra-microcrystalline, microcrystalline small length steel slab Δm with temperature t=−190° C. out of exhaust hood 8 into atmosphere, and the small length steel slab Δm completes the whole rapid solidification and cooling casting process to cast amorphous, ultra-microcrystalline, microcrystalline small length steel slab Δm continuously. Even though the small length steel slab Δm is pulled out of exhaust hood 8 into atmosphere, it has no effect on the casting of 0.23 C amorphous, ultra-microcrystalline, microcrystalline steel slab.

According to the above analysis, a conclusion is drawn that, embodiments of the present invention can completely substitute patent L to cast amorphous, ultra-microcrystalline, microcrystalline metal profiles with different brands and specifications and an ending temperature $t_2$=−190° C. The calculation formula and program of production parameters in patent L also apply to embodiments of the present invention in casting amorphous, ultra-microcrystalline, microcrystalline metal profiles with an ending temperature $t_2$=−190° C. The production parameters of rapid solidification and cooling casting process to produce amorphous, ultra-microcrystalline, microcrystalline steel listed in Table 3-Table 8 and amorphous, ultra-microcrystalline, microcrystalline aluminum listed in Table 9-Table 14 also apply to embodiments of the present invention. The production parameters are no longer listed in embodiments of the present invention.

The Table of thermophysical properties in embodiments of the present invention show that, the volume of ejected liquid nitrogen is V'=1.281 $dm^3$/Kg, the latent heat is r=190.7 KJ/Kg, and the ejected liquid nitrogen gasifies into low temperature nitrogen with a temperature of t=−190° C., a pressure of p=1.877 bar and a volume of V"=122.3 $dm^3$/Kg. It has to be noticed that the working condition of the low temperature nitrogen is t=−190° C. and p=1.877 bar when the latent heat is r=190.7 KJ/Kg. If the latent heat is not r=190.7 KJ/Kg, the working condition of the low temperature nitrogen is not t=−190° C. and p=1.877 bar. Therefore, the latent heat r=190.7 KJ/Kg must be adopted to determine the quantity of heat $\Delta Q_{2max}$ absorbed by the maximum ejection volume $\Delta V_{max}$ of liquid nitrogen during complete gasification based on the formula $\Delta Q_{2max}=\Delta V_{max}\cdot r/V'$, or the working condition of low temperature nitrogen produced by the heat absorption and gasification process cannot be t=−190° C. and p=1.877 bar and the constant temperature and pressure heat absorption and gasification process of casting amorphous, ultra-microcrystalline, microcrystalline metal profiles cannot be guaranteed. This is an important point to be noticed in the application of embodiments of the present invention.

To ensure the working condition of working chamber 8 in exhaust hood at constant temperature and pressure of t=−190° C., p=1.877 bar, the following technical measures are needed for the ejection system of liquid nitrogen:

1). it requires that the working condition of ejected liquid nitrogen is t=−190° C. and p=1.877 bar when liquid nitrogen ejector 5 ejects liquid nitrogen to the cross section C of small length steel slab Δm shown in FIG. 4. The pipelines, pumps, valves with different performance of ejection system of liquid nitrogen are required to take appropriate insulation technology in order to ensure the temperature of ejected liquid nitrogen at cross section be t=−190° C. Pressure relief valve can adjust the pressure of ejected liquid nitrogen to ensure that the pressure of ejected liquid nitrogen is p=1.877 bar when ejected liquid nitrogen reaches cross section C. The ejected liquid nitrogen is at the state point "e" (t=−190° C., p=1.877 bar) shown in FIG. 2. In accordance with the constant temperature and pressure curve e-f, the ejected liquid nitrogen absorbs heat and gasifies to produce low temperature nitrogen at a temperature of t=−190° C. and a pressure of p=1.877 bar, thus casting continuously qualified amorphous, ultra-microcrystalline, microcrystalline metal profiles with different brands and specifications.

2). when designing and manufacturing a powerful exhaust system, the exhaust amount of exhaust system should be set in accordance with the maximum low temperature nitrogen Vgmax and Vg corresponding to the t=−190° C., p=1.877 bar in Table 3-Table 14 of patent L and the following tables of embodiments of the present invention. And the amount of low temperature nitrogen exhausted can be appropriately adjusted. When the exhaust system exhausts $V_{gmax}$ and $V_g$ out of working chamber 8 of exhaust hood timely and rapidly to ensure that the low temperature nitrogen in working chamber 8 of exhaust hood is at t=−190° C., p=1.877 bar, the phase change of heat absorption and gasification of the ejected liquid nitrogen is in accordance with the constant temperature and pressure curve e-f and amorphous, ultra-microcrystalline, microcrystalline metal profiles with different brands and specifications are casted continuously.

3). the requirements about exhaust system in patent L are fully applicable to the exhaust system in embodiments of the present invention.

The exhaust hood of the powerful exhaust system is set at the outlet of hot casting mold. When casting 0.23 C amorphous, ultra-microcrystalline, microcrystalline steel slab with width of 1 m, the size of exhaust hood is determined as follows:

the width B=1.2 m, the length L=0.1 m, and the height H is determined by the specific location of exhaust hood at the outlet of hot casting mold. The final size and location is determined by production test.

3. Ending Temperature $t_2$ of Rapid Solidification and Cooling

In patent L, the ending temperature of rapid solidification and cooling $t_2$=−190° C. when casting amorphous, ultra-microcrystalline, microcrystalline metal profiles, because the temperatures of ejected liquid nitrogen and working chamber are both −190° C. But if the ending temperature is $t_2$=−190° C., the amorphous, ultra-microcrystalline, microcrystalline metal profiles need to cool down to $t_2$=−190° C. at a cooling rate $V_k$ after cooling down to normal ambient temperature when casting amorphous, ultra-microcrystalline, microcrystalline metal profiles using embodiments of the present invention and patent L. While these metal profiles usually work in normal ambient temperature. It is not necessary for these metal profiles to solidify and cool down to −190° C. It is uneconomical to consume ejected liquid nitrogen to make these metal profiles cool down from ambient temperature to −190° C. Amorphous, ultra-microcrystalline, microcrystalline metal profiles are used in the equipment, such as the space station, large passenger aircraft working at low temperature, cars, rail vehicles working in extremely cold area. The ending cooling temperature can be $t_2$=−190° C., −100° C. . . . and the temperature of product is −190° C., −100° C. . . . to cast amorphous, ultra-microcrystalline, microcrystalline metal profiles using embodiments of the present invention. The performance of products can be tested whether they meet the requirement of low temperature environment. In addition, to make further research, 25° C., 200° C., 500° C. can be determined to be the ending temperature $t_2$ when casting amorphous, ultra-microcrystalline, microcrystalline metal profiles in embodiments of the present invention.

The heat exchange between the ejected liquid nitrogen in working chamber 8 of exhaust hood and the heat conducted from liquid metal end of small length metal slab Δm are researched under a condition that ending temperatures are $t_2$=−100° C., 25° C., 200° C., 500° C. and the working chamber 8 of exhaust hood in FIG. 4 is at a normal ambient temperature and a pressure of 1 bar. As noted above, the process of heat exchange is the same as that in patent L. The calculation formula and program of production parameters in patent L also apply to embodiments of the present invention to cast amorphous, ultra-microcrystalline, microcrystalline metal profiles with maximum thickness $E_{max}$ and other thickness E. Because the ending temperature $t_2$ has changed and the initial rapid solidification and cooling temperature $t_1$ has not changed, thus the Δt has changed which leads to the change of other production parameters Δτ, Δm, u, $\Delta Q_{2max}$, $E_{max}$, $V_{max}$. When calculating the production parameters, just replace the value of $t_2$ in relevant formula from −190° C. to the adopted $t_2$ (such as −100° C., 25° C. . . . , etc.). The process of cooling down from $t_2$ to normal ambient temperature will be discussed below. In addition, the internal heat of the liquid metal of small length steel slab Δm from $t_1$ to $t_2$ is correspondingly smaller because $t_1$ is constant and $t_2$ increases during the rapid solidification and cooling casting process to cast amorphous, ultra-microcrystalline, microcrystalline metal profiles. The maximum thickness $E_{max}$, thickness E and traction speed "u" (that is productivity) of the amorphous, ultra-microcrystalline, microcrystalline metal profiles increase correspondingly when equivalent maximum ejection volume $V_{max}$ and ejection volume V are used.

The production parameters, casting 0.23 C amorphous, ultra-microcrystalline, microcrystalline small length steel slab with maximum thickness $E_{max}$ and other thickness E at the condition of ending temperature $t_2$, can be calculated as follows:

the production parameters and thermophysical properties of 0.23 C steel slab are as follows:

| | |
|---|---|
| B—width of the steel slab | B = 1 m |
| E—thickness of the steel slab | E = Xm |
| L—the latent heat | L = 310 KJ/Kg |
| $\lambda_{cp}$—average thermal conductivity | $\lambda_{cp} = 36.5 \times 10^{-3}$ KJ/m · ° C. · S |
| $C_{cp}$—average specific heat | $C_{cp}$ = 0.822 KJ/Kg · ° C. |
| $\rho_{cp}$—average density | $\rho_{cp} = 7.86 \times 10^3$ Kg/m$^3$ |
| $t_1$—initial solidification temperature | $t_1$ = 1550° C. |
| $t_2$—ending solidification and cooling temperature $t_2$ to be determined | |

Please refer to the pages 24/29~26/29 of specifications in patent L about the values of $\lambda_{cp}$, $C_{cp}$ and $\rho_{cp}$.

Thermophysical properties of ejected liquid nitrogen t—temperature of ejected liquid nitrogen, t=−190° C.

p—pressure of the ejected liquid nitrogen at t=−190° C., p=1.877 bar

V'—volume of 1 Kg ejected liquid nitrogen at t=−190° C. and p=1.877 bar, V'=1.281 dm$^3$/Kg V"—volume of nitrogen produced by the gasification of 1 Kg ejected liquid nitrogen at t=−190° C. and p=1.877 bar, V"=122.3 dm$^3$/Kg r—the latent heat at t=−190° C. and p=1.877 bar, that is heat that 1 Kg ejected liquid nitrogen absorbs at t=−190° C. and p=1.877 bar to gasify into nitrogen, r=190.7 KJ/Kg $K_{max}$ the maximum ejection speed of ejected liquid nitrogen, $K_{max}$=30 m/s h—the thickness of ejected liquid nitrogen layer, h=2 mm.

1) Using the R,R,C Method and Equipment to Cast 0.23 C Amorphous, Ultra-Microcrystalline, Microcrystalline Steel Slabs and the Determination of the Production Parameters at $t_2$=−100° C.

1. Using the R,R,C Method and Equipment to Cast 0.23 C Amorphous Steel Slabs and the Determination of the Production Parameters.

(1) Determine the Maximum Thickness $E_{max}$ of the 0.23 C Amorphous Steel Slab Using R,R,C Method and Equipment Determine the cooling rate $V_k$ in the whole solidification and cooling process of the 0.23 C. amorphous steel slab 1

Let $V_k = 10^{7\circ}$ C./s $t_2 = -100^\circ$ C.

calculate $\Delta t$ 2

$\Delta t = t_1 - t_2$ $t_1 = 1550^\circ$ C. $t_2 = -100^\circ$ C.

$\Delta t = 1550 - (-100) = 1650^\circ$ C.

calculate $\Delta\tau$ 3

$$\Delta\tau = \frac{\Delta t}{V_k} = \frac{1650}{10^7} = 1.65\times10^{-4}\ \text{s}$$

calculate $\Delta m$ 4

$$\Delta m = \sqrt{\frac{\lambda_{cp}}{\rho_{cp}c_{cp}}\cdot\Delta\tau} = \sqrt{\frac{36.5\times10^{-3}}{7.86\times10^3\times0.822}\times1.65\times10^{-4}} = 0.03053\ \text{mm}$$

calculate traction speed "$u$" 5

$$u = \frac{\Delta m}{\Delta\tau} = \frac{0.03053}{1.65\times10^{-4}}\times10^{-3}\times60 = 11.10\ \text{m/min}$$

calculate $\Delta V_{max}$ 6

$$\Delta V_{max} = 2BK_{max}\Delta\tau h = 2\times1\times10^3\times30\times10^3\times1.65\times10^{-4}\times2 = 0.0198\ \text{dm}^3$$

calculate $\Delta Q_{2max}$ 7

$$\Delta Q_{2max} = \frac{\Delta V_{max}\cdot r}{V'} = \frac{0.0198\times190.7}{1.281} = 2.9476\ \text{KJ}$$

calculate $E_{max}$ 8

$$E_{max} = \frac{\Delta Q_{2max}}{B\Delta m\rho_{cp}c_{cp}\Delta t} = \frac{2.9476}{100\times0.003053\times7.8\times10^{-3}\times0.822\times1650}\ \text{cm} = 9.13\ \text{mm}$$

calculate $V_{max}$ 9

$$V_{max} = 120BK_{max}h = 120\times1\times10^3\times30\times10^3\times2 = 7200\ \text{dm}^3/\text{min}$$

calculate $V_{gmax}$ 10

$$V_{gmax} = \frac{120BK_{max}h}{V'}V'' = \frac{120\times1\times10^3\times30\times10^3\times2}{1.281}\times122.3 = 687400.5\ \text{dm}^3/\text{min}$$

The above calculation indicates that when $t_2$=−100° C., $V_k$=° C./S, $V_{max}$=7200 dm$^3$/min, the 0.23 C amorphous steel slab with maximum thickness $E_{max}$=9.13 mm and width B=1000 mm can be casted continuously using R,R,C method and equipment.

(2) Determine the thickness E of the 0.23 C amorphous steel slab using R,R,C method and equipment Let $E = 5$ mm. The values of $V_k$, $\Delta\tau$, and $u$ for $E = 5$ mm are the same as that for $E_{max} = 9.13$ mm, that is, $V_k = 10^{7\circ}$ C./S, $\Delta\tau = 1.65\times10^{-4}$ S, $\Delta m = 0.03053$ mm, $u = 11.10$ m/min. 1 calculate X 2

$$X = \frac{E_{max}}{E} = \frac{9.13}{5} = 1.826$$

calculate $\Delta V$ 3

$$\Delta V = \frac{\Delta V_{max}}{X} = \frac{0.0198}{1.826} = 0.01084\ \text{dm}^3$$

calculate $\Delta Q_2$ 4

$$\Delta Q_2 = \frac{\Delta Q_{2max}}{x} = \frac{2.9476}{1.826} = 1.6142\ \text{KJ}$$

calculate $V$ 5

$$V = \frac{V_{max}}{X} = \frac{7200}{1.826} = 3943.04\ \text{dm}^3/\text{min}$$

calculate $V_g$ 6

$$V_g = \frac{V_{gmax}}{X} = \frac{687400.5}{1.826} = 376451.5\ \text{dm}^3/\text{min}$$

calculate $K$ 7

$$K = \frac{K_{max}}{X} = \frac{30}{1.826} = 16.43\ \text{m/s}$$

The above calculation indicates that when $t_2$ is fixed at $t_2$=−100° C., $V_k$=$10^{7\circ}$ C./S, the continuous casting speed u is fixed at 11.10 m/min and the thickness of ejected liquid nitrogen layer is fixed at 2 mm, the ejected quantity of liquid nitrogen falls to V=3943.04 dm$^3$/min from $V_{max}$=7200 dm$^3$/min, and the corresponding liquid nitrogen ejection speed drops to K=16.43 m/s. This will cast 0.23 C amorphous steel slab with E=5 mm continuously.

2. Using the R,R,C Method and Equipment to Cast 0.23 C Ultra-Microcrystalline Steel Slabs and the Determination of the Production Parameters The combination of cooling rates Vk used are 2×$10^{6\circ}$ C./S, 4×$10^{6\circ}$ C./S, 6×$10^{6\circ}$ C./S, 8×$10^{6\circ}$ C./S respectively.

(1) Determine the Maximum Thickness $E_{max}$ of the 0.23 C Ultra-Microcrystalline Steel Slab Using R,R,C Method and Equipment Determine the cooling rate $V_k$ in the whole solidification and cooling process of the 0.23 C. ultra-microcrystalline steel slab 1

Let $V_k = 2\times10^{6\circ}$ C./s $t_2 = -100^\circ$ C.

calculate $\Delta t$ 2

$\Delta t = t_1 - t_2 = 1550 - (-100) = 1650^\circ$ C.

calculate $\Delta\tau$ 3

$$\Delta\tau = \frac{t_1 - t_2}{V_k} = \frac{1650}{2\times10^6} = 8.25\times10^{-4}\ \text{s}$$

calculate $\Delta m$ 4

-continued $$\Delta m = \sqrt{\frac{\lambda_{cp}}{\rho_{cp}(C_{cp}\Delta t + L)V_k}} \cdot \Delta t = \sqrt{\frac{36.5\times10^{-3}}{7.86\times10^3(0.822\times1650+310)\times2\times10^6}} \times 1650 = 0.06159 \text{ mm}$$

calculate "$u$"

$$u = \frac{\Delta m}{\Delta\tau} = \frac{0.06159}{8.25\times10^{-4}} = 4.48 \text{ m/min}$$

calculate $\Delta V_{max}$ $$\Delta V_{max} = 2BK_{max}\Delta\tau h = 2\times1\times10^3\times30\times10^3\times8.25\times10^{-4}\times2 = 0.099 \text{ dm}^3$$

calculate $\Delta Q_{2max}$ $$\Delta Q_{2max} = \frac{\Delta V_{max}\cdot r}{V'} = \frac{0.099\times190.7}{1.281} = 14.74 \text{ KJ}$$

calculate $E_{max}$ $$E_{max} = \frac{\Delta Q_{2max}}{B\Delta m\rho_{cp}(C_{cp}\Delta t + L)} = \frac{14.74}{100\times0.006159\times7.86\times10^{-3}(0.822\times1650+310)} = 18.4 \text{ mm}$$

calculate $V_{max}$ $$V_{max} = 120BK_{max}h = 120\times1\times10^3\times30\times10^3\times2 = 7200 \text{ dm}^3/\text{min}$$

calculate $V_{gmax}$ $$V_{gmax} = \frac{120BK_{max}h}{V'}V'' = \frac{120\times1\times10^3\times30\times10^3\times2}{1.281}\times122.3 = 687400.5 \text{ dm}^3/\text{min}$$

The above calculation indicates that when $t_2$=−100, $V_K$=2×10$^{6\circ}$ C./S, $V_{max}$=7200 dm$^3$/min, the 0.23 C ultra-microcrystalline steel slab with maximum thickness $E_{max}$=18.4 mm and width B=1000 mm can be casted continuously using R,R,C method and equipment.

(2) Determine the Thickness E of the 0.23 C Ultra-Microcrystalline Steel Slab Using R,R,C Method and Equipment Let $E = 15$ mm. The values of $V_k$, $\Delta\tau$ and $u$ for $E = 15$ mm are the same as that for $E_{max} = 18.4$ mm, that is, $V_k = 2\times10^{6\circ}$ C./S, $\Delta\tau = 8.25\times10^{-4}$ S, $= 0.06159$ mm, $u = 4.48$ m/min. 1 calculate X 2

$$X = \frac{E_{max}}{E} = \frac{18.4}{15} = 1.227$$

calculate $\Delta V$ 3

$$\Delta V = \frac{\Delta V_{max}}{X} = \frac{0.099}{1.227} = 0.0807 \text{ dm}^3$$

calculate $\Delta Q_2$ 4

$$\Delta Q_2 = \frac{\Delta Q_{2max}}{X} = \frac{14.74}{1.227} = 12.01 \text{ KJ}$$

calculate $V$ 5

-continued $$V = \frac{V_{max}}{X} = \frac{7200}{1.227} = 5867.97 \text{ dm}^3/\text{min}$$

calculate $V_g$ 6

$$V_g = \frac{V_{gmax}}{X} = \frac{687400.5}{1.227} = 560228.6 \text{ dm}^3/\text{min}$$

calculate $K$ 7

$$K = \frac{K_{max}}{X} = \frac{30}{1.227} = 24.4 \text{ m/s}$$

The above calculation indicates that when the continuous casting speed u is fixed at 4.48 m/min and the thickness of ejected liquid nitrogen layer is fixed at 2 mm, the ejected quantity of liquid nitrogen falls to V=5867.97 dm$^3$/min, and the corresponding liquid nitrogen ejection speed drops to K=24.4 m/s. This will cast 0.23 C ultra-microcrystalline steel slab with E=15 mm, $t_2$=−100, $V_K$=2×10$^{6\circ}$ C./S continuously.

The formulae and programs used for calculating the production parameters at other cooling rate combinations $V_k$ to produce 0.23 C ultra-microcrystalline steel slab with maximum thickness $E_{max}$ are the same as those for cooling rate Vk=2×10$^{6\circ}$ C./S. The calculation results are listed below. The calculation process will not be repeated herein.

The calculation result of the production parameters of 0.23 C ultra-microcrystalline steel slab with maximum thickness $E_{max}$ is as follows when $V_K$ is 4×10$^{6\circ}$ C./S and $t_2$ is −100° C.:

Δt=1650, Δτ=4.125×10$^{-4}$ s, Δm=0.04355 mm, u=6.34 m/min, $\Delta V_{max}$=0.0495 dm$^3$, $\Delta Q_{2max}$=7.369 KJ, $E_{max}$=12.92 mm, $V_{max}$=7200 dm$^3$/min, $V_{gmax}$=687400.5 dm$^3$/min.

The calculation result of the production parameters of 0.23 C ultra-microcrystalline steel slab with maximum thickness $E_{max}$ is as follows when $V_K$ is 6×10$^{6\circ}$ C./S and $t_2$ is −100° C.:

Δt=1650, Δτ=2.75×10$^{-4}$ s, Δm=0.03556 mm, u=7.76 m/min, $\Delta V_{max}$=0.033 dm$^3$, $\Delta Q_{2max}$=4.912 KJ, $E_{max}$=10.5 mm, $V_{max}$=7200 dm$^3$/min, $V_{gmax}$=687400.5 dm$^3$/min.

The calculation result of the production parameters of 0.23 C ultra-microcrystalline steel slab with maximum thickness $E_{max}$ is as follows when $V_K$ is 8×10$^{6\circ}$ C./S and $t_2$ is −100° C.: Δt=1650° C., Δτ=2.0625×10$^{-4}$ s, Δm=0.0308 mm, u=8.96 m/min, $\Delta V_{max}$=0.0248 dm$^3$, $\Delta Q_{2max}$=3.685 KJ, $E_{max}$=9.14 mm, $V_{max}$=7200 dm$^3$/min, $V_{gmax}$=687400.5 dm$^3$/min.

The formulae and programs used for calculating the production parameters at other cooling rate combinations $V_k$ to produce 0.23 C ultra-microcrystalline steel slab with maximum thickness $E_{max}$ are the same as those for cooling rate Vk=2×10$^{6\circ}$ C./S. The calculation process will not be repeated herein.

3. Using the R,R,C Method and Equipment to Cast 0.23 C Microcrystalline Steel Slabs and the Determination of the Production Parameters (1) Determine the Maximum Thickness $E_{max}$ of the 0.23 C Microcrystalline Steel Slab (1) Using R,R,C Method and Equipment Determine the cooling rate $V_k$ in the whole solidification and cooling process of the 0.23 C. microcrystalline steel slab (1) 1

-continued

Let $V_k = 10^{6\circ}$ C./S $t_2 = -100^\circ$ C.

calculate $\Delta t$ 2

$\Delta t = t_1 - t_2 = 1550 - (-100) = 1650^\circ$ C.

calculate $\Delta\tau$ 3

$$\Delta\tau = \frac{\Delta t}{V_K} = \frac{1650}{10^6} = 1.65\times10^{-3}\ \text{C./S}$$

calculate $\Delta m$ 4

$$\Delta m = \sqrt{\frac{\lambda_{cp}}{\rho_{cp}(C_{cp}\Delta t + L)V_K}}\cdot\Delta t = \sqrt{\frac{36.5\times10^{-3}}{7.86\times10^3(0.822\times1650+310)\times10^6}}\times1650 = 0.0871\ \text{mm}$$

calculate "$u$" 5

$$u = \frac{\Delta m}{\Delta\tau} = \frac{0.0871}{1.65\times10^{-3}} = 3.17\ \text{m/min}$$

calculate $\Delta V_{max}$ 6

$$\Delta V_{max} = 2BK_{max}\Delta\tau h = 2\times1\times10^3\times30\times10^3\times1.65\times10^{-3}\times2 = 0.198\ \text{dm}^3$$

calculate $\Delta Q_{2max}$ 7

$$\Delta Q_{2max} = \frac{\Delta V_{max}\cdot r}{V'} = \frac{0.198\times190.7}{1.281} = 29.476\ \text{KJ}$$

calculate $E_{max}$ 8

$$E_{max} = \frac{\Delta Q_{2max}}{B\Delta m\rho_{cp}(C_{cp}\Delta t + L)} = \frac{29.476}{100\times0.00871\times7.86\times10^{-3}(0.822\times1650+310)} = 26\ \text{mm}$$

calculate $V_{max}$ 9

$$V_{max} = 120BK_{max}h = 120\times1\times10^3\times30\times10^3\times2 = 7200\ \text{dm}^3/\text{min}$$

calculate $V_{gmax}$ 10

$$V_{gmax} = \frac{120BK_{max}h}{V'}V'' = \frac{120\times1\times10^3\times30\times10^3\times2}{1.281}\times122.3 = 687400.5\ \text{dm}^3/\text{min}$$

(2) Determine the Thickness E of the 0.23 C Microcrystalline Steel Slab (1) Using R,R,C Method and Equipment Let $E = 20$ mm. The values of $V_k$, $\Delta\tau$ and $u$ for $E = 20$ mm are the same as that for $E_{max}$, that is, $V_k = 10^{6\circ}$ C./S, $\Delta\tau = 1.65\times10^{-3}$ S, $\Delta m = 0.0871$ mm, $u = 3.17$ m/min. 1 calculate X 2

$$X = \frac{E_{max}}{E} = \frac{26}{20} = 1.3$$

calculate $\Delta V$ 3

$$\Delta V = \frac{\Delta V_{max}}{X} = \frac{0.198}{1.3} = 0.152\ \text{dm}^3$$

calculate $\Delta Q_2$ 4

$$\Delta Q_2 = \frac{\Delta Q_{2max}}{X} = \frac{29.476}{1.3} = 22.67\ \text{KJ}$$

calculate $V$ 5

$$V = \frac{V_{max}}{X} = \frac{7200}{1.3} = 5538.46\ \text{dm}^3/\text{min}$$

calculate $V_g$ 6

$$V_g = \frac{V_{gmax}}{X} = \frac{687400.5}{1.3} = 528769.6\ \text{dm}^3/\text{min}$$

calculate $K$ 7

$$K = \frac{K_{max}}{X} = \frac{30}{1.3} = 23.07\ \text{m/s}$$

The formulae and programs using the R,R,C method and equipment used for calculating the production parameters to produce 0.23 C microcrystalline steel slab (2) at $t_2$=−100° C. with maximum thickness $E_{max}$ are the same as those for microcrystalline steel slab (1). The calculation process will not be repeated herein.

Maximum thickness $E_{max}$ and the production parameters of 0.23 C amorphous, ultra-microcrystalline, microcrystalline and fine grain steel slabs with $t_2$=−100° C. (B=1 m, h=2 mm) using R,R,C method and equipment are listed in Table 1.

TABLE 1

Maximum thickness $E_{max}$ and the production parameters of 0.23C amorphous, ultra-microcrystalline, microcrystalline and fine grain steel slabs with $t_2 = -100^\circ$ C. (B = 1 m, h = 2 mm)

| Metal structure | Amorphous | Ultra-microcrystalline | | | | Microcrystalline (1) | Microcrystalline (2) | Fine grain |
|---|---|---|---|---|---|---|---|---|
| $V_K$/° C./s | $10^7$ | $8\times10^6$ | $6\times10^6$ | $4\times10^6$ | $2\times10^6$ | $10^6$ | $10^5$ | $10^4$ |
| Δτ/s | $1.65\times10^{-4}$ | $2.06\times10^{-4}$ | $2.75\times10^{-4}$ | $4.13\times10^{-4}$ | $8.25\times10^{-4}$ | $1.65\times10^{-3}$ | $1.65\times10^{-2}$ | $1.65\times10^{-1}$ |
| Δm/mm | 0.03053 | 0.03080 | 0.03556 | 0.04355 | 0.06159 | 0.0871 | 0.2754 | 0.8710 |
| u/m/min | 11.10 | 8.96 | 7.76 | 6.34 | 4.48 | 3.17 | 1.0 | 0.317 |
| $\Delta V_{max}$/dm³ | 0.0198 | 0.0248 | 0.033 | 0.0495 | 0.099 | 0.198 | 1.98 | 19.8 |
| $\Delta Q_{2max}$/KJ | 2.9476 | 3.6845 | 4.912 | 7.3690 | 14.74 | 29.476 | 294.76 | 2947.6 |
| $E_{max}$/mm | 9.13 | 9.14 | 10.5 | 12.92 | 18.40 | 26 | 81.7 | 258.37 |
| $V_{max}$/dm³/min | 7200 | 7200 | 7200 | 7200 | 7200 | 7200 | 7200 | 7200 |
| $V_{gmax}$/dm³/min | 687400.5 | 687400.5 | 687400.5 | 687400.5 | 687400.5 | 687400.5 | 687400.5 | 687400.5 |

TABLE 2

E = 20 mm, the production parameters of 0.23C amorphous, ultra- microcrystalline, microcrystalline and fine grain steel slabs with $t_2$ = −100° C. (B = 1 m, h = 2 mm)

| Metal structure | Amorphous | Ultra-microcrystalline | | | | Microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 11.10 | 8.96 | 7.76 | 6.34 | 4.48 | 3.17 | 1.0 | 0.317 |
| X | | | | | | 1.3 | 4.085 | 12.92 |
| V/dm³/min | | | | | | 5538.46 | 1762.5 | 557.3 |
| $V_g$/dm³/min | | | | | | 528769.6 | 168274.3 | 53204.4 |
| K/m/s | | | | | | 23.08 | 7.34 | 2.32 |

TABLE 3

E = 15 mm, the production parameters of 0.23C amorphous, ultra- microcrystalline, microcrystalline and fine grain steel slabs with $t_2$ = −100° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 11.10 | 8.96 | 7.76 | 6.34 | 4.48 | 3.17 | 1.0 | 0.317 |
| X | | | | | 1.23 | 1.73 | 5.45 | 17.23 |
| V/dm³/min | | | | | 5853.66 | 4161.85 | 1321.1 | 417.88 |
| $V_g$/dm³/min | | | | | 558862.2 | 397341.3 | 126128.5 | 39895.6 |
| K/m/s | | | | | | 23.08 | 7.34 | 2.32 |

TABLE 4

E = 10 mm, the production parameters of 0.23C amorphous, ultra- microcrystalline, microcrystalline and fine grain steel slabs with $t_2$= −100° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 11.10 | 8.96 | 7.76 | 6.34 | 4.48 | 3.17 | 1.0 | 0.317 |
| X | | | 1.05 | 1.292 | 1.84 | 2.6 | 8.17 | 25.84 |
| V/dm³/min | | | 6857.14 | 5572.76 | 3913.04 | 2769.2 | 881.27 | 278.6 |
| $V_g$/dm³/min | | | 654667.14 | 532043.73 | 373587.23 | 264384.8 | 84137.14 | 26602.19 |
| K/m/s | | | 28.57 | 23.22 | 16.30 | 11.54 | 3.67 | 1.16 |

TABLE 5

E = 5 mm, the production parameters of 0.23C amorphous, ultra- microcrystalline, microcrystalline and fine grain steel slabs with $t_2$ = −100° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 11.10 | 8.96 | 7.76 | 6.34 | 4.48 | 3.17 | 1.0 | 0.317 |
| X | 1.826 | 1.828 | 2.1 | 2.584 | 3.68 | 5.2 | 16.34 | 51.67 |
| V/dm³/min | 3943.05 | 3938.73 | 3428.57 | 2786.38 | 1956.52 | 1384.62 | 440.64 | 139.35 |
| $V_g$/dm³/min | 376451.5 | 376039.7 | 327333.6 | 266021.87 | 186793.6 | 132192.4 | 42068.6 | 13303.67 |
| K/m/s | 16.43 | 16.41 | 14.29 | 11.61 | 8.15 | 5.77 | 1.84 | 0.58 |

2) Using the R,R,C Method and Equipment to Cast 0.23 C Amorphous, Ultra-Microcrystalline, Microcrystalline and Fine Grain Steel Slabs and the Determination of the Production Parameters at $t_2$=25° C.

The meaning of the determination of the ending temperature $t_2$=25° C. is that, the cooling rate $V_k$ is constant during the process that 0.23 C liquid steel solidifies and cools down from initial rapid solidification and cooling temperature $t_1$=1550° C. to ending cooling temperature $t_2$=25° C. at a corresponding cooling rate $V_k$ ($10^{7}$° C./s, $8\times10^{6}$° C./s-$2\times10^{6}$° C./s, $10^{6}$° C./s, $10^{5}$° C./s, $10^{4}$° C./s). The temperatures of 0.23 C amorphous, ultra-microcrystalline, microcrystalline and fine grain steel slabs are 25° C. of which the temperatures and mechanical properties are consistent with the actual working environment. It is suitable for working in the actual work environment.

In addition, the rapid solidification and cooling of continuously casting process is finished when the liquid steel of small length metal slab Δm solidifies and cools down from $t_1$=1550° C. to $t_2$=25° C. It is unnecessary to cool down from $t_2$=25° C. to t=−190° C. Thus there is no need to eject liquid nitrogen into working chamber 8 of exhaust hood to absorb the internal heat of small length steel slab Δm from $t_2$=25° C. to t=−190° C. The maximum thickness $E_{max}$, thickness E and productivity "u" increase correspondingly when equivalent maximum ejection volume $V_{max}$ and ejection volume V are used in casting amorphous, ultra-microcrystalline, microcrystalline metal profiles.

The formulae and programs used for calculating the production parameters at $t_2$=25° C. to produce 0.23 C amorphous, ultra-microcrystalline, microcrystalline and fine grain steel slabs are the same as those for $t_2$=−100° C. The $t_2$ of −100° C. in formulae is replaced by 25° C. The calculation process will not be repeated herein. The calculation results are listed below.

TABLE 6

Maximum thickness $E_{max}$ and the production parameters of 0.23C amorphous, ultra-microcrystalline, microcrystalline and fine grain steel slabs with $t_2$ = 25° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| Δτ/s | $1.525 \times 10^{-4}$ | $1.906 \times 10^{-4}$ | $2.542 \times 10^{-4}$ | $3.810 \times 10^{-4}$ | $7.625 \times 10^{-4}$ | $1.525 \times 10^{-3}$ | $1.525 \times 10^{-2}$ | $1.525 \times 10^{-1}$ |
| Δm/mm | 0.02935 | 0.02938 | 0.03393 | 0.04156 | 0.05877 | 0.08310 | 0.2628 | 0.8311 |
| u/m/min | 11.55 | 9.25 | 8.01 | 6.54 | 4.62 | 3.27 | 1.03 | 0.327 |
| $\Delta V_{max}/dm^3$ | 0.0183 | 0.0229 | 0.0305 | 0.0485 | 0.0915 | 0.183 | 1.83 | 18.3 |
| $\Delta Q_{2max}$/KJ | 2.7243 | 3.4054 | 4.5410 | 6.811 | 13.62 | 27.2 | 272.4 | 2724.3 |
| $E_{max}$/mm | 9.42 | 9.43 | 10.9 | 13.3 | 18.9 | 26.7 | 84.4 | 266.7 |
| $V_{max}/dm^3$/min | 7200 | 7200 | 7200 | 7200 | 7200 | 7200 | 7200 | 7200 |
| $V_{gmax}/dm^3$/min | 687400.5 | 687400.5 | 687400.5 | 687400.5 | 687400.5 | 687400.5 | 687400.5 | 687400.5 |

TABLE 7

E = 20 mm, the production parameters of 0.23C amorphous, ultra- microcrystalline, microcrystalline and fine grain steel slabs with $t_2$ = 25° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 11.55 | 9.25 | 8.01 | 6.54 | 4.62 | 3.27 | 1.03 | 0.327 |
| X | | | | | | 1.33 | 4.22 | 13.34 |
| $V/dm^3$/min | | | | | | 5393.3 | 1706.2 | 539.9 |
| $V_g/dm^3$/min | | | | | | 516842.5 | 162891.1 | 51529.3 |
| K/m/s | | | | | | 22.56 | 7.11 | 2.25 |

TABLE 8

E = 15 mm, the production parameters of 0.23C amorphous, ultra- microcrystalline, microcrystalline and fine grain steel slabs with $t_2$ = 25° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 11.55 | 9.25 | 8.01 | 6.54 | 4.62 | 3.27 | 1.03 | 0.327 |
| X | | | | | 1.26 | 1.78 | 5.63 | 17.78 |
| $V/dm^3$/min | | | | | 5714.3 | 4044.9 | 1278.9 | 404.9 |
| $V_g/dm^3$/min | | | | | 545555.95 | 386180.06 | 122096.0 | 38661.4 |
| K/m/s | | | | | 23.81 | 16.85 | 5.33 | 1.69 |

TABLE 9

E = 10 mm, the production parameters of 0.23C amorphous, ultra- microcrystalline, microcrystalline and fine grain steel slabs with $t_2$ = 25° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 11.55 | 9.25 | 8.01 | 6.54 | 4.62 | 3.27 | 1.03 | 0.327 |
| X | | | 1.09 | 1.33 | 1.89 | 2.67 | 8.44 | 26.67 |
| V/dm³/min | | | 6605.5 | 5413.5 | 3809.5 | 2696.6 | 853.1 | 270.0 |
| $V_g$/dm³/min | | | 630642.7 | 516842.5 | 363704.0 | 257453.4 | 81445.6 | 25774.3 |
| K/m/s | | | 27.53 | 22.56 | 15.87 | 11.24 | 3.56 | 1.13 |

TABLE 10

E = 5 mm, the production parameters of 0.23C amorphous, ultra- microcrystalline, microcrystalline and fine grain steel slabs with $t_2$ = 25° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 11.55 | 9.25 | 8.01 | 6.54 | 4.62 | 3.27 | 1.03 | 0.327 |
| X | 1.884 | 1.886 | 2.18 | 2.66 | 3.78 | 5.34 | 16.88 | 53.34 |
| V/dm³/min | 3821.7 | 3817.6 | 3302.8 | 2706.8 | 1904.8 | 1348.3 | 426.5 | 135.0 |
| $V_g$/dm³/min | 364862.3 | 364475.3 | 315321.3 | 258421.2 | 181852.1 | 128726.7 | 40722.8 | 12887.2 |
| K/m/s | 15.92 | 15.91 | 13.76 | 11.28 | 7.94 | 5.62 | 1.78 | 0.562 |

3) Using the R, R, C Method and Equipment to Cast 0.23 C Amorphous, Ultra-Microcrystalline, Microcrystalline and Fine Grain Steel Slabs and the Determination of the Production Parameters at $t_2$=200° C.

Recorded in the specifications of patent L in Line 12 on page 25/29(30), the transformation temperature $T_g$ and melting point temperature $T_m$ of amorphous metal has a relationship of $T_g/T_m>0.5$[1]. For 0.23 C carbon steel, $T_g$ is higher than 750° C., that is, the transformation temperature $T_g$ is one of the temperatures higher than 750° C. Using R,R,C method and equipment, the 0.23 C amorphous steel slab is produced through a rapid solidification and cooling process from $t_1$=1550° C. to $t_2$=200° C. at a cooling rate $V_K=10^7$° C./S within time interval $$\Delta\tau = \frac{t_1 - t_2}{V_k} = (1550 - 200)/10^7 \text{ S} = 1.35 \times 10^{-4} \text{ S}.$$

In embodiments of the present invention, the 0.23 C liquid steel is required to solidify and cool down from $t_1$=1550° C. to $t_2$=200° C. at a cooling rate $V_k$ and within corresponding $\Delta\tau$ to obtain ultra-microcrystalline, microcrystalline and fine grain steel slabs. The rapid solidification and cooling process in embodiments of the present invention is the same as that in patent L. While the cooling rate of the cooling process from $t_2$=200° C. to ambient temperature 25° C. is no longer the cooling rate $V_k$ corresponding to amorphous, ultra-microcrystalline, microcrystalline and fine grain, but the ambient cooling rate $V_{R200}$ of the cooling process out of working chamber 8 from $t_2$=200° C. to ambient temperature 25° C. shown in FIG. 3 and FIG. 4. So what is the effect of the cooling process from 200° C. to 25° C. to the mechanical properties of amorphous, ultra-microcrystalline, microcrystalline, fine grain metal structures produced by the solidification and cooling process from $t_1$=1550° C. to $t_2$=200° C.? This is the subject that needs further observation and research.

It is worth noting that, during the cooling process from 200° C. to 25° C., the heat contained in the 0.23 C amorphous, ultra-microcrystalline, microcrystalline, fine grain steel slabs with $t_2$=200° C. is not absorbed by the heat absorption and gasification process of ejected liquid nitrogen but absorbed by the air out of working chamber 8. Therefore, when equivalent maximum ejection volume $V_{max}$ and other ejection volume V compared to $t_2$=25° C., −100° C. are used in casting amorphous, ultra-microcrystalline, microcrystalline steel slabs with $t_2$=200° C., steel slabs with thicker $E_{max}$ and E can be casted and productivity "u" increases correspondingly. The formulae and programs used for calculating the production parameters are the same as those for $t_2$=25° C. The calculation process will not be repeated herein. The calculation results are listed below.

TABLE 11

Maximum thickness $E_{max}$ and the production parameters of 0.23C amorphous, ultra-microcrystalline, microcrystalline and fine grain steel slabs with $t_2$ = 200° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| Δτ/s | $1.35 \times 10^{-4}$ | $1.68 \times 10^{-4}$ | $2.25 \times 10^{-4}$ | $3.38 \times 10^{-4}$ | $6.75 \times 10^{-4}$ | $1.35 \times 10^{-3}$ | $1.35 \times 10^{-2}$ | $1.35 \times 10^{-1}$ |
| Δm/mm | 0.02762 | 0.02729 | 0.03152 | 0.03860 | 0.05160 | 0.07720 | 0.2442 | 0.7720 |
| u/m/min | 12.3 | 9.75 | 8.41 | 6.86 | 4.85 | 3.43 | 1.085 | 0.3432 |
| $\Delta V_{max/dm}{}^3$ | 0.0162 | 0.0202 | 0.027 | 0.0405 | 0.0810 | 0.162 | 1.62 | 16.2 |
| $\Delta Q_{2max}$/KJ | 2.41 | 3.0 | 4.02 | 6.03 | 12.06 | 24.12 | 241.2 | 2411.7 |
| $E_{max}$/mm | 10.01 | 9.85 | 11.43 | 14.00 | 19.8 | 28 | 88.48 | 280.1 |
| $V_{max}$/dm³/min | 7200 | 7200 | 7200 | 7200 | 7200 | 7200 | 7200 | 7200 |
| $V_{gmax}$/dm³/min | 687400.5 | 687400.5 | 687400.5 | 687400.5 | 687400.5 | 687400.5 | 687400.5 | 687400.5 |

TABLE 12

E = 20 mm, the production parameters of 0.23C amorphous, ultra- microcrystalline, microcrystalline and fine grain steel slabs with $t_2$ = 200° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 12.3 | 9.75 | 8.41 | 6.86 | 4.85 | 3.43 | 1.085 | 0.3432 |
| X | | | | | | 1.4 | 4.424 | 14.00 |
| V/dm³/min | | | | | | 5142.9 | 1627.5 | 514.2 |
| $V_g$/dm³/min | | | | | | 491000.4 | 155379.9 | 49100.0 |
| K/m/s | | | | | | 21.43 | 6.78 | 2.14 |

TABLE 13

E = 15 mm, the production parameters of 0.23C amorphous, ultra- microcrystalline, microcrystalline and fine grain steel slabs with $t_2$ = 200° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 12.3 | 9.75 | 8.41 | 6.86 | 4.85 | 3.43 | 1.085 | 0.3432 |
| X | | | | | 1.32 | 1.87 | 5.90 | 18.67 |
| V/dm³/min | | | | | 5454.5 | 3857.1 | 1220.6 | 387.7 |
| $V_g$/dm³/min | | | | | 520758.0 | 368250.3 | 116534.9 | 36811.9 |
| K/m/s | | | | | 22.73 | 16.07 | 5.09 | 1.61 |

50

TABLE 14

E = 10 mm, the production parameters of 0.23C amorphous, ultra- microcrystalline, microcrystalline and fine grain steel slabs with $t_2$ = 200° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 12.3 | 9.75 | 8.41 | 6.86 | 4.85 | 3.43 | 1.085 | 0.3432 |
| X | 1 | | 1.143 | 1.4 | 1.98 | 2.8 | 8.848 | 28.01 |
| V/dm³/min | 7200 | | 6299.2 | 5142.9 | 3636.4 | 2571.4 | 813.7 | 257.1 |
| $V_g$/dm³/min | 687400.5 | | 601400.3 | 491000.4 | 347172.0 | 245500.2 | 77689.9 | 24541.3 |
| K/m/s | 30 | | 26.25 | 21.43 | 15.15 | 10.71 | 3.39 | 1.071 |

TABLE 15

E = 5 mm, the production parameters of 0.23C amorphous, ultra -microcrystalline, microcrystalline and fine grain steel slabs with $t_2$ = 200° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 12.3 | 9.75 | 8.41 | 6.86 | 4.85 | 3.43 | 1.085 | 0.3432 |
| X | 2.0 | 1.97 | 2.29 | 2.8 | 3.96 | 5.6 | 17.70 | 56.02 |
| V/dm³/min | 3600 | 3654.8 | 3149.6 | 2571.4 | 1818.2 | 1285.7 | 406.8 | 128.5 |
| $V_g$/dm³/min | 343700.3 | 348934.3 | 300700.1 | 245500.2 | 173586.0 | 122750.1 | 38845.0 | 12270.6 |
| K/m/s | 15.0 | 15.23 | 13.12 | 10.8 | 7.58 | 5.36 | 1.70 | 0.54 |

4) Using the R,R,C Method and Equipment to Cast 0.23 C Amorphous, Ultra-Microcrystalline, Microcrystalline and Fine Grain Steel Slabs and the Determination of the Production Parameters at $t_2$=500° C.

It is very necessary to cast 0.23 C amorphous, ultra-microcrystalline, microcrystalline and fine grain steel slabs continuously with $t_2$=500° C. using R,R,C method and equipment. 0.23 C amorphous, ultra-microcrystalline, microcrystalline and fine grain steel slabs with $t_2$=500° C. are produced through rapid solidification and cool casting from $t_1$=1550° C. to $t_2$=500° C. of 0.23 C liquid steel at a cooling rate $V_K$ within corresponding time interval $\Delta\tau$. The problem is that the cooling rate of the cooling process from $t_2$=500° C. to ambient temperature 25° C. is no longer the cooling rate $V_k$ corresponding to amorphous, ultra-microcrystalline, microcrystalline and fine grain, but the ambient cooling rate $V_{R500}$ of the cooling process out of working chamber 8 from $t_2$=500° C. to ambient temperature 25° C. shown in FIG. 3 and FIG. 4. So what is the effect of the cooling process from 500° C. to 25° C. to the mechanical properties of amorphous, ultra-microcrystalline, microcrystalline, fine grain metal structures produced by the solidification and cooling process from $t_1$=1550° C. to $t_2$=500° C.? This is the subject that needs further observation and research. Although the cooling process from t2=500° C. to t=25° C. is under the transformation temperature of amorphous metal and amorphous metal structure should not change, the temperature of $t_2$=500° C. is still a little higher. Will the inner structure of amorphous metal structure be changed when the cooling rate becomes slow suddenly? Will dislocation exit in grains of ultra-microcrystalline, microcrystalline and fine grain? Will the grains of ultra-microcrystalline, microcrystalline and fine grain grow up? If the cooling process has little effect on the mechanical properties of casted amorphous, ultra-microcrystalline, microcrystalline and fine grain metal structures, it is very suitable to adopt $t_2$=500° C. to cast 0.23 C amorphous, ultra-microcrystalline, microcrystalline and fine grain steel slabs. And it is possible to develop a new industrial field of amorphous, ultra-microcrystalline, microcrystalline and fine grain metal materials similar to metal heat treatment and pressure processing if further research is done on the possibility of metal thermal processing and the change of mechanical properties within the range of $t_2$=500° C.

On the other hand, during the cooling process from 200° C. to 25° C., the heat contained in the 0.23 C amorphous, ultra-microcrystalline, microcrystalline, fine grain steel slabs with $t_2$=500° C. is absorbed by the air out of working chamber 8. Therefore, when equivalent maximum ejection volume $V_{max}$ and other ejection volume V are used in casting amorphous, ultra-microcrystalline, microcrystalline steel slabs, steel slabs with thicker $E_{max}$ and E than those steel slabs of $t_2$=200° C. and 25° C. can be casted and productivity "u" increases correspondingly. The formulae and programs used for calculating the production parameters are the same as those for $t_2$=200° C. The calculation process will not be repeated herein. The calculation results are listed below.

TABLE 16

Maximum thickness $E_{max}$ and the production parameters of 0.23C amorphous, ultra-microcrystalline, microcrystalline and fine grain steel slabs with $t_2$ = 500° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| $\Delta\tau$/s | $1.05 \times 10^{-4}$ | $1.31 \times 10^{-4}$ | $1.75 \times 10^{-4}$ | $2.63 \times 10^{-4}$ | $5.25 \times 10^{-4}$ | $1.05 \times 10^{-3}$ | $1.05 \times 10^{-2}$ | $1.05 \times 10^{-1}$ |
| $\Delta$m/mm | 0.02436 | 0.02336 | 0.02697 | 0.03303 | 0.04671 | 0.06606 | 0.2089 | 0.6606 |
| u/m/min | 13.92 | 10.68 | 9.25 | 7.55 | 5.339 | 3.775 | 1.194 | 0.3775 |
| $\Delta V_{max}$/dm³ | 0.01260 | 0.01575 | 0.0210 | 0.0315 | 0.063 | 0.126 | 1.26 | 12.6 |
| $\Delta Q_{2max}$/KJ | 1.8757 | 2.35 | 3.126 | 4.689 | 9.379 | 18.757 | 187.57 | 1875.7 |
| $E_{max}$/mm | 11.35 | 10.89 | 12.57 | 15.40 | 21.77 | 30.79 | 97.38 | 307.9 |
| $V_{max}$/dm³/min | 7200 | 7200 | 7200 | 7200 | 7200 | 7200 | 7200 | 7200 |
| $V_{gmax}$/dm³/min | 687400.5 | 687400.5 | 687400.5 | 687400.5 | 687400.5 | 687400.5 | 687400.5 | 687400.5 |

TABLE 17

E = 25 mm, the production parameters of 0.23C amorphous, ultra- microcrystalline, microcrystalline and fine grain steel slabs with $t_2$ = 500° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 13.92 | 10.68 | 9.25 | 7.55 | 5.339 | 3.775 | 1.194 | 0.3775 |
| X | | | | | | 1.232 | 3.90 | 12.316 |
| V/dm³/min | | | | | | 5846.1 | 1848.4 | 584.6 |
| $V_g$/dm³/min | | | | | | 558136.2 | 176473.7 | 55813.6 |
| K/m/s | | | | | | 24.36 | 7.70 | 2.4 |

TABLE 18

E = 20 mm, the production parameters of 0.23C amorphous, ultra- microcrystalline, microcrystalline and fine grain steel slabs with $t_2$ = 500° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 13.92 | 10.68 | 9.25 | 7.55 | 5.339 | 3.775 | 1.194 | 0.3775 |
| X | | | | | 1.089 | 1.540 | 4.869 | 15.395 |
| V/dm³/min | | | | | 6614.6 | 4676.8 | 1478.7 | 467.7 |
| $V_g$/dm³/min | | | | | 631511.7 | 446508.9 | 141179.0 | 44650.9 |
| K/m/s | | | | | 27.56 | 19.49 | 6.16 | 1.95 |

TABLE 19

E = 15 mm, the production parameters of 0.23C amorphous, ultra- microcrystalline, microcrystalline and fine grain steel slabs with $t_2$ = 500° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 13.92 | 10.68 | 9.25 | 7.55 | 5.339 | 3.775 | 1.194 | 0.3775 |
| X | | | | 1.027 | 1.452 | 2.053 | 6.492 | 20.527 |
| V/dm³/min | | | | 7013.0 | 4961.0 | 3507.6 | 1109.1 | 350.8 |
| $V_g$/dm³/min | | | | 669546.0 | 473633.8 | 334881.7 | 105884.2 | 33488.2 |
| K/m/s | | | | 29.22 | 20.67 | 14.62 | 4.62 | 1.46 |

TABLE 20

E = 10 mm, the production parameters of 0.23C amorphous, ultra- microcrystalline, microcrystalline and fine grain steel slabs with $t_2$ = 500° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 13.92 | 10.68 | 9.25 | 7.55 | 5.339 | 3.775 | 1.194 | 0.3775 |
| X | 1.135 | 1.089 | 1.257 | 1.54 | 2.177 | 3.079 | 9.738 | 30.79 |
| V/dm³/min | 6343.6 | 6611.6 | 5727.9 | 4675.3 | 3307.3 | 2338.4 | 739.4 | 233.8 |
| $V_g$/dm³/min | 605639.2 | 631221.8 | 546858.0 | 446364.0 | 315756.0 | 223254.5 | 70589.5 | 22325.5 |
| K/m/s | 26.43 | 27.55 | 23.87 | 19.48 | 13.78 | 9.74 | 3.08 | 0.97 |

TABLE 21

E = 5 mm, the production parameters of 0.23C amorphous, ultra- microcrystalline, microcrystalline and fine grain steel slabs with $t_2$ = 500° C. (B = 1 m, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| u/m/min | 13.92 | 10.68 | 9.25 | 7.55 | 5.339 | 3.775 | 1.194 | 0.3775 |
| X | 2.27 | 2.178 | 2.514 | 3.08 | 4.354 | 6.158 | 19.476 | 61.58 |
| V/dm$^3$/min | 3171.8 | 3305.8 | 2864.0 | 2337.7 | 1653.7 | 1169.2 | 369.7 | 117.0 |
| $V_g$/dm$^3$/min | 302819.6 | 315610.9 | 273429.0 | 223182.0 | 157877.9 | 111627.2 | 35294.8 | 11162.7 |
| K/m/s | 13.21 | 13.77 | 11.93 | 9.74 | 6.89 | 4.87 | 1.54 | 0.49 |

5) The Values of Maximum Thickness $E_{max}$ Corresponding to Different Ending Temperatures $t_2$ Using the R,R,C Method and Equipment to Cast 0.23 C Amorphous, Ultra-Microcrystalline, Microcrystalline and Fine Grain Steel Slabs are Listed in Table 22.

TABLE 22

Maximum thickness $E_{max}$ corresponding to different $t_2$ of 0.23C amorphous, ultra-microcrystalline, microcrystalline and fine grain steel slabs

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| $t_2$ = −190° C. $E_{max}$/mm | 8.9 | 9 | 10.4 | 12.8 | 18 | 25.5 | 80.6 | 255 |
| $t_2$ = −100° C. $E_{max}$/mm | 9.13 | 9.14 | 10.5 | 12.9 | 18.4 | 26 | 81.7 | 258.4 |
| $t_2$ = 25° C. $E_{max}$/mm | 9.42 | 9.43 | 10.89 | 13.34 | 18.9 | 26.7 | 84.35 | 266.7 |
| $t_2$ = 200° C. $E_{max}$/mm | 10.01 | 9.85 | 11.43 | 14.00 | 19.8 | 28.0 | 88.48 | 280.1 |
| $t_2$ = 500° C. $E_{max}$/mm | 11.35 | 10.89 | 12.57 | 15.40 | 21.77 | 30.79 | 97.38 | 307.9 |

The data in Table 22 shows that the maximum thickness $E_{max}$ of 0.23 C amorphous, ultra-microcrystalline, microcrystalline and fine grain steel slabs increases with the increase of ending temperature $t_2$ from −190° C. to 500° C. The maximum thickness $E_{max}$ of amorphous steel slabs increases from 8.9 mm to 11.35 mm. The maximum thickness $E_{max}$ of microcrystalline (1) steel slabs increases from 25.5 mm to 30.79 mm. The maximum thickness $E_{max}$ of ultra-microcrystalline steel slabs at a cooling rate of $V_K$=2×$10^6$ increases from 18 mm to 21.77 mm. The selection of $t_2$ depends on the test, research results and practical needs in actual production.

The R,R,C method and equipment can be used for the continuous casting of various non-ferrous amorphous, ultra-microcrystalline, microcrystalline and fine grain metal profiles (including aluminum alloy, titanium alloy, copper alloy, and the like.). The working principle, formulae and programs used for calculating the maximum thickness $E_{max}$ to produce 0.23 C amorphous, ultra-microcrystalline, microcrystalline and fine grain steel slabs are the same as those for 0.23 C steel slab. For simplicity, the calculation of maximum thickness $E_{max}$ of the casted amorphous, ultra-microcrystalline, microcrystalline and fine grain steel slabs with ending temperature $t_2$=25° C. is taken for example for various non-ferrous metal alloys. The calculation process will not be repeated herein. The calculation results are listed in Table 23.

TABLE 23

Maximum thickness $E_{max}$ and the production parameters of 0.23C amorphous, ultra-microcrystalline, microcrystalline and fine grain aluminum slabs with $t_2$ = 25° C. (B = 1 m, $K_{max}$ = 30 m/s, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_K$/° C./s | $10^7$ | $8 \times 10^6$ | $6 \times 10^6$ | $4 \times 10^6$ | $2 \times 10^6$ | $10^6$ | $10^5$ | $10^4$ |
| Δτ/s | $7.25 \times 10^{-5}$ | $9.0625 \times 10^{-5}$ | $1.208 \times 10^{-4}$ | $1.8125 \times 10^{-4}$ | $3.625 \times 10^{-4}$ | $7.25 \times 10^{-4}$ | $7.25 \times 10^{-3}$ | $7.25 \times 10^{-2}$ |
| Δm/mm | 0.08138 | 0.07415 | 0.08562 | 0.1050 | 0.1483 | 0.2097 | 0.6632 | 2.097 |
| u/m/min | 67.35 | 49.094 | 42.52 | 34.715 | 24.547 | 17.357 | 5.489 | 1.7357 |
| $\Delta V_{max}$/dm$^3$ | 0.0087 | 0.0109 | 0.0145 | 0.02175 | 0.0435 | 0.087 | 0.87 | 8.7 |
| $\Delta Q_{2max}$/KJ | 1.295 | 1.619 | 2.159 | 3.238 | 6.476 | 12.95 | 129.5 | 1295.2 |
| $E_{max}$/mm | 7.809 | 7.115 | 8.216 | 10.06 | 14.23 | 20.1 | 63.639 | 201.28 |

TABLE 23-continued

Maximum thickness $E_{max}$ and the production parameters of 0.23C amorphous, ultra-microcrystalline, microcrystalline and fine grain aluminum slabs with $t_2$ = 25° C. (B = 1 m, $K_{max}$ = 30 m/s, h = 2 mm)

| Metal structure | Amorphous | Ultra-microcrystalline | | | | microcrystalline (1) | Microcrystalline (2) | Fine grain |
|---|---|---|---|---|---|---|---|---|
| $V_{max}$/dm³/min | 7200 | 7200 | 7200 | 7200 | 7200 | 7200 | 7200 | 7200 |
| $V_{gmax}$/dm³/min | 687400.5 | 687400.5 | 687400.5 | 687400.5 | 687400.5 | 687400.5 | 687400.5 | 687400.5 |

The calculation process and results of other thickness E of the amorphous, ultra-microcrystalline, microcrystalline and fine grain aluminum slabs will not be repeated herein and the calculation results are not listed. As for the formulae and programs for maximum thickness Emax and other thickness E, and related production parameters are the same as those for 0.23 C amorphous, ultra-microcrystalline, microcrystalline and fine grain steel slabs or profiles. It will not be repeated in the specifications.

4. Description of Several Technical Problems

The continuous molding method in patent L and the patent R (the embodiments of the present invention) is derived from continuous ingot casting. The heat of the liquid steel in crystallizer passes through the thin coating on the surface of crystallizer, the metal walls of crystallizer to the cooling water and is conducted out by the cooling water flowing out of crystallizer. The liquid steel in the crystallizer cools into a red hot steel with a red hot solid steel outer layer and a red hot liquid inner. The traction mechanism pulls out the red hot steel from the crystallizer and sprays water to cool down, thus casting the steel ingot.

The continuous casting method in patent L and patent R uses liquid nitrogen ejector at the outlet of hot casting mold which replaces the crystallizer of continuous ingot device. The liquid nitrogen ejected by the liquid nitrogen ejector cools the liquid steel through the heat absorption and gasification principle. The heat that 1 Kg ejected liquid nitrogen absorbs at t=−190° C. and p=1.877 bar to gasify into nitrogen is 190.7 KJ/Kg. The heat is much greater than the heat absorbed by the metal walls of crystallizer and cooling water. The cooling rate of liquid steel is also much greater than that of continuous casting ingot. The cooling rate of both cannot be matched. While the thickness (10-30 mm) of slabs is smaller than the thickness (>100 mm) of continuous casting ingot. Therefore, there is no doubt to cast steel slab with width of 1 m, thickness of 9.42 mm, 18.9 mm, 26.7 mm, at room temperature $t_2$=25° C. using the rapid solidification and cooling method and equipment in patent R. As for casting the steel slabs with thickness of 9.42 mm, 18.9 mm, 26.7 mm, whether they are amorphous, ultra-microcrystalline, microcrystalline steel slabs depends on the specific technical measures below.

The rapid solidification and cooling method for casting amorphous, ultra-microcrystalline, microcrystalline steel slabs in patent L and patent R are composed of three technical aspects. First, in the amorphous, ultra-microcrystalline, microcrystalline small length metal slab Δm with width B and thickness $E_{max}$ (E), the heat conducted from the section "A" of liquid metal to the section "C" of solid steel in the time interval Δτ is $\Delta Q_{max}(\Delta Q)$.

Second, the heat $\Delta Q_{max}(\Delta Q)$ can be conducted to each surface of the intersection of the outlet of hot casting mold and ejected liquid nitrogen layer from the cross section C in the time interval Δτ. Then ejection volume $\Delta V_{max}$ (ΔV) of liquid nitrogen ejected to and covered on the surface of steel in the time interval Δτ absorbs the heat $\Delta Q_{max}(\Delta Q)$ through the heat absorption and gasification process and changes into low temperature nitrogen. The low temperature nitrogen is exhausted by a powerful exhaust system from working chamber of exhaust hood to the atmospheric environment. Amorphous, ultra-microcrystalline, microcrystalline steel slabs can be cooled down rapidly and solidification casted through the three technical aspects.

1. Application Conditions of One Dimensional Steady Heat Conduction Formula.

The application conditions of one dimensional steady heat conduction formula must be meet in order to determine the heat $\Delta Q_{max}(\Delta Q)$ conducted from the section A of liquid metal of small length metal slab Δm to section C. There are two aspects about the application conditions of one dimensional steady heat conduction formula. First, the length $E_{max}$(E) of either side of two sections with a distance of Δm of the small length metal slab which is perpendicular to the heat conduction direction (that is the traction direction of traction mechanism) needs to meet the following requirement, $E_{max}(E)>10\ \Delta m$. The requirement is explained in detail in patent L and can be met. Second, relative macroscopic motion is forbidden between each section of small length steel slab Δm. Only relative thermal motion between molecules is allowed to conduct heat. There is no problem for the solidified steel slab about the second aspect. The problem is that there is a small part of liquid steel in small length steel slab Δm. Macroscopic convective or turbulent motion of this small part of liquid steel is forbidden, that is, the liquid steel in the whole hot mold cannot generate convection or turbulence at macro level. Or, the heat conducted from section "A" of liquid metal in small length metal slab Δm to section "C" of solid steel is much greater than $\Delta Q_{2max}(\Delta Q_2)$ and one dimensional steady state heat conduction formula can not be established. All the production parameters for amorphous, ultra-microcrystalline, microcrystalline steel slabs calculated in the specification in patent L cannot be used. According to this, high-frequency AC power cannot be used for the electric heating element in the hot mold in order to avoid the convection or turbulence of liquid steel. The inner surface of the hot mold is heated by the electric heating element, ensuring that the liquid steel does not condense on the inner surface of the hot mold so as not to affect the smooth movement of liquid steel in hot mold, also ensuring the surface of steel slab pulled out from hot mold is smooth. In addition, the height difference of two ladles, the placement of liquid steel flowing into mid-ladle, the length of hot mold need to be controlled well when liquid steel in casting ladle flows into mid-ladle. It ensures that there is no relative macroscopic motion of liquid steel in hot mold, the flow to the outlet is a translational and steady, and the flow rate of translation of liquid steel is the traction speed of traction mechanism. After taking the above measures, one dimensional steady heat conduction formula is workable to calculate the production parameters of rapid cooling and solidification process to cast amorphous, ultra-microcrystalline, microcrystalline steel slabs. The production parameters can be used in actual production and produce amorphous, ultra-microcrystalline, microcrystalline steel slabs which are in accordance with the calculation results. A few errors may exist.

2. The Rapid Process of Internal Heat of Steel Slab Conducting to Surface of Steel Slab, and the Structure of Ejection Nozzle of Liquid Nitrogen.

When casting 0.23 C amorphous steel slab using patent R, the production parameters are $\Delta\tau=1.525\times10^{-4}$ s, $\Delta m=0.02935$ mm, $\Delta Q_{2max}=2.7243$ KJ, $\Delta V_{max}=0.0183$ $dm^3$ and $E_{max}=9.42$ mm (shown in Table 6 in the embodiments of the present invention). During the production process, liquid nitrogen with thickness h=2 mm is ejected by the ejection nozzle of liquid nitrogen to surface of steel slab that is cooled rapidly, solidified and pulled out from the outlet of the hot mold. The covering effect of ejected liquid nitrogen layer is B=1 m and within the range of 2-3 mm outside the outlet of hot mold. The heat $\Delta Q_{2max}=2.7243$ KJ needs to be conducted from the cross section "C" of small length metal slab $\Delta m=0.02935$ mm to the surface of steel slab within the covering effect of liquid nitrogen layer above in the time interval $\Delta\tau=1.525\times10^{-4}$ s. And the heat is rapidly and completely absorbed by the maximum ejection volume $\Delta V_{max}$ of liquid nitrogen through heat absorption and gasification process, thus casting the amorphous steel slab structure with $\Delta m=0.02935$ mm and $E_{max}=9.42$ mm.

Can the heat $\Delta Q_{2max}$ be conducted from cross section "C" to each surface of steel slab covered by ejected nitrogen within time interval $\Delta\tau$?

It should have no problem realizing the heat conduction to surface of steel slab and heat exchange with ejected liquid nitrogen at the surface and surface layers (for example, 1 to 2 mm) of steel slab. Amorphous metal structure can be produced by rapid cooling and solidification process. While the heat in the center of steel slab needs about 5 mm to conduct to the surface of steel slab and to exchange heat with ejected liquid nitrogen. Is the heat exchange among the center of steel slab, the surface of steel slab and ejected liquid nitrogen the same? Are the metal structures the same? According to the principle of heat transfer, the temperature of rapid cooling and solidification steel slab pulled out from hot mold is fixed at $t_2=25°$ C. Each channel of the heat conduction from the center of the steel slab to the surface of the steel slab is carried out on the isothermal surface of $t_2=25°$ C. The thermal resistance $\Delta R$ of heat conduction on the isothermal surface is 0, so there is no resistance of the heat conduction from the center of the steel slab to the surface of the steel slab. That is, the process and rate of the heat exchange of center of steel slab and surface layer of steel slab to surface of steel slab and ejected liquid nitrogen layer are the same. The metal structure of center of steel slab and surface layer of steel slab are the same amorphous metal structure.

The ejection nozzle of liquid nitrogen is required to eject liquid nitrogen layer with thickness h=2 mm uniformly to the upper and lower surfaces of the steel slab with width B=1 m at a ejection speed of $K_{max}=30$ m/s. The angle between the ejected liquid nitrogen and steel slab is initially set as 15° to 30°. The angle is finally determined by the production test. The temperature and pressure is required as t=−190° C., p=1.877 bar when ejected liquid nitrogen intersects to the steel slab.

3. Determine and Regulate the Thickness of Ejected Liquid Nitrogen Layer "h", the Maximum Ejection Speed $K_{max}$ and Ending Temperature $t_2$.

According to the above analysis, it is completely possible to conduct the heat $\Delta Q_{2max}$ from the cross section C of $\Delta m$ to the surface of steel slab, out of the outlet of hot mold and covered by ejected liquid nitrogen, within time interval $\Delta\tau$. It is the restrictive technical part that whether the ejected liquid nitrogen can absorb all the heat $\Delta Q_{2max}$ and transform into nitrogen through heat absorption and gasification process within time interval $\Delta\tau$. Because the requirement must be met in order to produce the required amorphous, ultra-microcrystalline, microcrystalline metal structure of small length $\Delta m$ and finally produce amorphous, ultra-microcrystalline, microcrystalline steel slab. The thickness of ejected liquid nitrogen layer h=2 mm and maximum ejection speed of liquid nitrogen $K_{max}=30$ m/s is set according to the requirement. The above values are set in the reference to the cooling pipe parameters of US nuclear power plant. In US nuclear power plant, the pipe diameter of cooling water pipe is 5 mm, the flow rate of cooling water is 30 m/s, and the maximum flow rate of cooling water is 45 m/s.

The thickness of ejected liquid nitrogen layer h=2 mm is determined according to the pipe diameter 5 mm of cooling water pipe in US nuclear power plant. Because the thickness of the cooling water layer involved in the heat absorption, gasification and boiling in the cooling water pipe is equivalent to 2.5 mm. When the heat $\Delta Q_{2max}$ conducting from cross section C to the surface of solidified steel slab covered by ejected nitrogen, the heat exchange between ejected liquid nitrogen and the heat $\Delta Q_{2max}$ is very fast because the thickness of ejected liquid nitrogen layer is 2 mm and very thin, and the ejection speed is $K_{max}=30$ m/s and very fast. The ejected liquid nitrogen absorbs all the heat $\Delta Q_{2max}$ within time interval $\Delta\tau$ and gasifies into nitrogen which is exhausted by the powerful exhaust system (there will be no obstacle by the liquid nitrogen layer with h=2 mm). The liquid steel of small length metal $\Delta m$ cools down rapidly and solidifies into amorphous, ultra-microcrystalline, microcrystalline metal structure and finally produces amorphous, ultra-microcrystalline, microcrystalline steel slab.

The production parameters can be regulated according to the parameters of cooling water of US nuclear power plant if the effect of rapid cooling and solidification is not good enough with the production parameters h=2 mm, $K_{max}=30$ m/s of ejected liquid nitrogen. The thickness of ejected liquid nitrogen is h=1.3 mm when the maximum ejection speed is Kmax=45 m/s and the maximum ejection volume of liquid nitrogen $\Delta V_{max}$ is fixed at 7200$dm^3$/min. Using the above mentioned production parameters, the effect of rapid cooling and solidification is much better than the production parameters of h=2 mm and $K_{max}=30$ m/s. In view of the above, in the implementation of the patent L and patent R, the ejected system of liquid nitrogen, ejection nozzle of liquid nitrogen, traction mechanism, hot mold and casting ladle and the like should be full considered in designing and manufacturing the equipment. In this way, the likelihood of success is much greater and the regulated range of the production parameters is wider when the production test is carried out.

In the implementation of patent L and patent R for the continuous casting of amorphous, ultra-microcrystalline, microcrystalline steel slabs, the heat $\Delta Q_1(\Delta Q_2)$ must be fully absorbed by ejected liquid nitrogen in the time interval $\Delta\tau$. As for the patent L, when ejected liquid just begins to intersect with the solidified steel slab at cross section C and covers on the surface of steel slab, the temperatures of steel slab and ejected liquid nitrogen are both −190° C. with Δt=0. There is no heat exchange between ejected liquid nitrogen and the steel slab because the adherent temperature gradient of the ejected liquid nitrogen layer is 0. Over time within Δτ, the heat $\Delta Q_1(\Delta Q_2)$ in small length metal slab Δm is conducted gradually from cross section A to cross section C on the surface of steel slab. The temperature of the surface of steel slab gradually increases, the adherent temperature gradient of the ejected liquid nitrogen gradually increases, and the heat exchange between ejected liquid nitrogen and steel slab is started. The amorphous, ultra-microcrystalline, microcrystalline steel slab with small length metal slab Δm is rapidly cooled and solidified when ejected liquid nitrogen absorbs all the heat of $\Delta Q_1(\Delta Q_2)$ through heat absorption and gasification in the time interval Δτ. As for the patent R, when $t_2$ is selected as 25° C. and ejected liquid just begins to intersect with the solidified steel slab at cross section C and covers on the surface of steel slab, the temperatures of steel slab and ejected liquid nitrogen are 25° C. and −190° C. respectively with Δt of 215° C. The adherent temperature gradient of the ejected liquid nitrogen is much greater than that in patent L when Δτ=0. Because the temperature of liquid nitrogen is t=−190° C. which is higher than the boiling point of liquid nitrogen, the liquid nitrogen ejected to the surface of steel slab is in an unstable state. The ejected liquid nitrogen layer is very thin with high adherent temperature gradient. The liquid nitrogen can absorbs heat and gasify into nitrogen as long as there is heat conducting to the surface of steel slab. That is, the rate at which the liquid nitrogen absorbs heat of $\Delta Q_1(\Delta Q_2)$ through heat absorption and gasification in the time interval Δτ is faster than that in patent L. Therefore, in the casting of microcrystalline, microcrystalline steel slabs, the rate of rapid cooling and solidification is much easier to implement in patent R compared to patent L. Compared to patent L, patent R is more successful in ensuring rapid cooling and solidification to cast amorphous, microcrystalline, microcrystalline steel slabs. In patent R compared to patent L, the effect of the selection of different $t_2$ is similar to the above situation in the rapid cooling and solidified casting of amorphous, ultra-microcrystalline, microcrystalline steel slab. Therefore, it will not be repeated herein.

4. Preventing the Flow of Liquid Steel from the Outlet of Hot Mold

After the start of liquid nitrogen ejection device, when the cross section B of solid-liquid metal interface moves 0.5 mm away from the outlet of hot mold by the rapid cooling and solidification effect of ejected liquid nitrogen to the liquid steel in hot mold, traction mechanism is started to pull the rapidly cooled, solidified small length metal slab Δm and the subsequent rapidly cooled, solidified steel slab out of the outlet of hot mold. And the cross section b is fixed at the position 0.5 mm away from the outlet of hot mold without change with the rapid cooling and solidification process of liquid steel Δm. Thus, the liquid steel won't flow out from the outlet of hot mold.

When 0.23 C amorphous steel slab is casted at $t_2$=25° C., Δτ is $1.525\times10^{-4}$ s, Δm is 0.02935 mm and $E_{max}$=4.92 mm. Under the rapid cooling effect of ejected liquid nitrogen, at the position 0.5 mm away from the outlet of hot mold in an extremely short time of Δτ, the temperature of a very small length liquid steel a-b (shown in FIG. 4) drops rapidly to solidus temperature from $t_1$=1550° C. The liquid steel a-b cools to solid instantly of which the volume contracts sharply, and leaves the surface of hot mold. The amorphous thin slab of Δm=0.02935 mm no longer contacts with the inner surface of hot mold. Thus, the traction force required of traction mechanism is very small. The surface of the amorphous steel slab pulled out from hot mold is smooth. The metal structure of the steel slab is dense.

5. The Feasibility in Implementation of Patent L and Patent R

All the major operations are made in a space 2-3 mm out away from the outlet of hot mold when patent L and patent R are used for production. So it is necessary to monitor closely the situation occurred in the space, wherein to ensure the predetermined temperature of steel slab and constant temperature of rapid cooling and solidification, such as t=25° C. is the most important thing to notice. After doing this, there is no thermal resistance of the heat conduction from the center of the steel slab to the surface of the steel slab. The metal structure of center of steel slab and surface layer of steel slab are the same amorphous, ultra-microcrystalline, microcrystalline metal structures by the heat absorption and solidification of ejected nitrogen liquid. If we cannot do this, there will be difference in metal structure between the center of steel slab and surface layer of steel slab, leading to the decrease in the mechanical properties of the steel slab. To do this, it is required that the liquid nitrogen ejection system, the traction mechanism, the exhaust system, the hot mold and so on are operated strictly according to the production parameters. And this depends on the technical level and the management level of an enterprise. On the other hand, it is feasible to the implementation of patent L and patent R after the strengthening of technical level and management of an enterprise level.

6. Environmental Issues

For steel enterprises, after the implementation of patent L and patent R, the technology and equipment for continuous casting and repeated hot rolling will be replaced by steel slab factory, steel plant and steel tube factory using disposable, fast and simple R,R,C method. The quality of product is excellent, the cost is low and the production environment is very environmentally friendly. After the implementation of patent L and patent R, the strength of microcrystalline steel increased by over 6 times. Producing the microcrystalline steel can make the national steel production capacity decrease from 900 million tons to 150 million tons just in terms of the strength. Thus, how much carbon emissions of national can reduce? How much iron ore, coke and other resources can be saved? The environmental issues will be greatly improved.

The basic principle of R, R, C method and equipment for casting amorphous, ultra-microcrystalline, microcrystalline and the like, metal profiles in embodiments of the present invention is the same as that in patent L. Embodiments of the invention are developed from patent L. But compared to patent L, embodiments of the present invention are more advanced without special requirements of the low temperature of working chamber and insulation technology. Amorphous, ultra-microcrystalline, microcrystalline and fine grain metal profiles of different brands and specifications with thicker thickness of maximum thickness $E_{max}$ compared to patent L can be casted continuously. The ending temperature $t_2$ of rapid solidification and cooling can be selected according to the temperature requirements of working environment of amorphous, super-microcrystalline, microcrystalline metal slabs or profiles to produce amorphous, super-microcrystalline, microcrystalline metal slabs or profiles which are more suitable in different working environments, while the cost is much lower.

Therefore, although the basic principles of embodiments of the present invention and patent L are the same, embodiments of the present invention have the characteristics of advanced technology, superior performance of product, lower cost and more promising.

It should be noted that the term "comprising" does not exclude other elements or steps and the use of articles "a" or "an" does not exclude a plurality. Also elements described in association with different embodiments may be combined. It should also be noted that reference signs in the claims should not be construed as limiting the scope of the claims.

What is claimed is:

1. An R,R,C method and equipment for casting amorphous, ultra-microcrystalline, microcrystalline, metal profiles, comprising a working chamber of an exhaust hood, and a working cold source of liquid nitrogen are used, the working chamber of the exhaust hood is located at the outlet of a hot mold, and a fixed thickness of liquid nitrogen layer by a liquid nitrogen ejector, and the ejected liquid nitrogen intersects to pulled-out metal slabs or profiles at cross section C where the temperature and pressure are required to be t=−190° C. and p=1.877 bar, the shape and size of an outlet section of the hot mold is the same as those of the produced slabs or profiles; for the casting of metal slabs, a traction mechanism for pulling metal slabs away from the outlet of hot mold with width of B and thickness of E, the traction speed is continuous casting speed u, small length metal slab Δm is pulled out in a time interval Δτ and ejected liquid nitrogen intersects to the pulled-out metal slabs at cross section C; in the same time interval Δτ as above, through a heat absorption and gasification process, ejected liquid nitrogen absorbs all the internal heat of small length metal slab Δm from initial rapid solidification and cooling temperature $t_1$ to ending cooling temperature $t_2$; the liquid metal of small length metal slabs Δm solidify into corresponding amorphous, ultra-microcrystalline, microcrystalline and fine grain metal structure at different cooling rates $V_k$, amorphous, ultra-microcrystalline, microcrystalline and fine grain ferrous and non-ferrous metal slabs with different specifications and brands can be casted continuously by repeating the process; at the same time with the heat absorption and gasification process of ejected liquid nitrogen, a powerful exhaust system exhausts the nitrogen produced by gasification of the ejected liquid nitrogen out from the working chamber of exhaust hood; the working chamber of exhaust hood is set at the outlet of the hot mold and the liquid nitrogen ejector; the temperature on cross section C is the ending cooling temperature $t_2$; and (1) determining the calculation formula of production parameters only related to metal thermal properties and metal structure: cooling rate $V_k$, time interval Δτ of rapid solidification and cooling process, the small length metal slab Δm casted continuously within the time interval Δτ, continuous casting speed u;

(2) determining the formula of parameters of liquid nitrogen ejection which are used in the technology of high ejection speed and extremely thin liquid film ejection and only related to metal thermal properties and heat contained in metal slabs: ejection volume of liquid nitrogen V, thickness of liquid nitrogen ejection layer h, ejection speed of liquid nitrogen K, and the volume of nitrogen $V_g$ produced by the gasification of the ejection volume of liquid nitrogen V;

(3) determining the calculation programs for casting amorphous, ultra-microcrystalline, microcrystalline and fine grain steel slabs or profiles with maximum thickness $E_{max}$ and other thickness E;

wherein, the first letter R in R,R,C method represents room temperature and is the first capital letter of room temperature; the second letter R represents rapid solidification and is the first capital letter of rapid solidification; the third letter C represents continuous casting and is the first capital letter of continuous casting.

2. The R,R,C method and equipment for casting amorphous, ultra-microcrystalline, microcrystalline, metal profiles according to claim 1, wherein, the related parameters for the casting of metal profiles are calculated according to the below formulae:

1) the cooling rates $V_k$ for rapid solidification of ferrous and non-ferrous metal are as follows, for amorphous metal structure, $V_k \geq 10^{7\circ}$ C./S;

for ultra-microcrystalline metal structure, $V_k = 10^{6\circ}$ C./S~$10^{7\circ}$ C./S;

for microcrystalline metal structure, $V_k = 10^{4\circ}$ C./S~$10^{6\circ}$ C./S;

for fine grain metal structure, $V_k \leq 10^{4\circ}$ C./S;

2) the time interval Δτ is calculated with the following formula, wherein Δτ is the time interval of the solidification and cooling of liquid metal from initial rapid cooling solidification temperature $t_1$ to ending cooling temperature $t_2$ in casting small length metal slab Δm having a rectangular section with a width of B and thickness of E:

$$\Delta\tau = \Delta t / V_k \text{ S}$$

3) the calculation of heat conduction $\Delta Q_1$ for small length metal slab Δm between a cross section A and the cross section C within the time interval Δτ; the temperature of the metal on the cross section A is the initial cooling and solidification temperature $t_1$ of liquid metal, the heat conduction between cross section A and cross section C is considered as one dimensional steady heat conduction if the thickness E of slabs requires E>10 Δm; according to the principle of one dimensional steady heat conduction, the heat conduction $\Delta Q_1$ for small length metal slab Δm between a cross section A and the cross section C within the time interval Δτ is calculated by the following formula, $$\Delta Q_1 = \lambda_{cp} A \Delta\tau \Delta t / \Delta m \text{ KJ}$$

4) internal heat $\Delta Q_2$ of liquid metal contained in the small length metal slab Δm is calculated with the following formulae:

for amorphous metal, $$\Delta Q_2 = BE\Delta m \rho_{cp} C_{cp} \Delta t \text{ KJ}$$

for ultra-microcrystalline, microcrystalline and fine grain metal, $$\Delta Q_2 = BE\Delta m \rho_{cp} (C_{cp}\Delta t + L) \text{ KJ}$$

5) the small length metal slab Δm being casted continuously in the time interval Δτ is calculated with the following formulae:

for amorphous metal, $$\Delta m = \sqrt{\Delta_{CP}\Delta\tau / (\rho_{CP} C_{CP})} \text{ mm}$$

for ultra-microcrystalline, microcrystalline and fine grain metal, $$\Delta m = \sqrt{\frac{\lambda_{CP}}{\rho_{CP}(C_{CP}\Delta t + L)V_K}} \cdot \Delta t \text{ mm}$$

6) the continuous casting speed u is calculated with the following formula, $$u = \Delta m / \Delta\tau \text{ m/s}$$

7) quantity of the ejection volume liquid nitrogen ΔV required to absorb the internal heat contained in liquid metal of the small length metal slab Δm within the time interval Δτ is calculated with the following formula, $$\Delta V=\Delta Q_2 V'/r \text{ dm}^3$$

8) the ejection volume of liquid nitrogen V and the volume of nitrogen $V_g$ produced by the gasification of the ejection volume of liquid nitrogen V at a pressure of P=1.877 bar and a temperature t=−190° C. are calculated with the following formulae respectively, $$V=60\cdot\Delta V/\Delta\tau=60\cdot\Delta Q_2 V'/(r\Delta\tau) \text{ dm}^3/\text{min}$$

$$V_g=60\cdot\Delta Q_2 V''/(r\Delta\tau) \text{ dm}^3/\text{min}$$

9) the thickness h of liquid nitrogen ejection layer and the liquid nitrogen ejection speed K are calculated with the following formulae, $$h=\Delta Q_2 V'/(2BKr\Delta\tau) \text{ mm}$$

Δt is the temperature difference between cross section A and cross section C, $\Delta t=t_1-t_2$° C.;

K is the liquid nitrogen ejection speed, m/s;

$\lambda_{cp}$ is the average thermal conductivity, W/m·° C.;

A is the sectional area perpendicular to the thermal conductivity direction, $m^2$;

B is the width of the metal slabs, m;

E is the thickness of the metal slabs, m;

$\rho_{cp}$ is the average density, $g/cm^3$;

$C_{cp}$ is the average specific heat, KJ/Kg·° C.;

L is the latent heat, KJ/Kg;

V' is the volume of 1 Kg ejected liquid nitrogen at t=−190° C. and p=1.877 bar, V'=1.281 $dm^3$/Kg;

r is the latent heat at t=−190° C. and p=1.877 bar 1 Kg ejected liquid nitrogen absorbs at t=−190° C. and p=1.877 bar to gasify into nitrogen, r=190.7 KJ/Kg;

V" is the volume of nitrogen produced by the gasification of 1 Kg ejected liquid nitrogen at t=−190° C. and p=1.877 bar, V"=122.3 $dm^3$/Kg;

when amorphous, ultra-microcrystalline, microcrystalline and fine grain metal slabs are casted with R,R,C method and equipment, the cooling rate $V_k$, the traction speed u of traction mechanism (6), ejection volume of liquid nitrogen V of liquid nitrogen ejector (5) and liquid nitrogen ejection speed K can be determined according to the required amorphous, ultra-microcrystalline, microcrystalline and fine grain metal structures, and the width B, thickness E, thickness of liquid nitrogen ejection layer h, maximum liquid nitrogen ejection speed $K_{max}$, initial cooling and solidification temperature $t_1$ and ending cooling temperature $t_2$ of required metal slabs.

3. The R,R,C method and equipment for casting amorphous, ultra-microcrystalline, microcrystalline, metal profiles according to claim 2, wherein, the maximum thickness $E_{max}$ and other thickness E of metal slabs are calculated according to the below formulae:

1) calculating the values of $V_K$, Δτ, $\Delta Q_1$, $\Delta Q_2$, Δm, u and using the first six formulae in claim 2;

2) calculating $\Delta V_{max}$ $$\Delta V_{max}=2BK_{max}\Delta\tau h \text{ dm}^3$$

let $K_{max}$=30 m/s, B=1 m, h=2 mm, the value of h is fixed in the following calculation;

3) calculating $\Delta Q_{2max}$ $$\Delta Q_{2max}=\Delta V_{max} r/V' \text{ KJ}$$

4) calculating $E_{max}$ for amorphous steel slabs, $$E_{max}=\Delta Q_{2max}/(B\Delta m\rho_{CP}C_{CP}\Delta t) \text{ mm}$$

for ultra-microcrystalline, microcrystalline and fine grain slabs, $$E_{max}=\Delta Q_{2max}/(B\Delta m\rho_{CP}(C_{CP}\Delta t+L)) \text{ mm}$$

5) calculating $V_{max}$ and $V_{gmax}$ $$V_{max}=120BK_{max}h \text{ dm}^3/\text{min}$$

$$V_{gmax}=120BK_{max}hV''/V' \text{ dm}^3/\text{min}$$

6) calculating proportional coefficient "x"

$$x=E_{max}/E$$

7) calculating parameters of slabs with other thickness E the Δm and u of E are the same as those of $E_{max}$, $\Delta Q_2$, ΔV, V and $V_g$ are calculated with the following formulae, $$x=\Delta Q_{2max}/\Delta Q_2=\Delta V_{max}/\Delta V=V_{max}/V=V_{gmax}/V_g$$

8) calculating K when h is fixed at 2 mm, the ejection volume of liquid nitrogen drops from $V_{max}$ to V, and the liquid nitrogen ejection speed drops from $K_{max}$ to K, $$x=K_{max}/K$$

the following can be calculated in accordance with the above formulae, for 0.23 C amorphous steel slab, $E_{max}$ is 8.9 mm;

for 0.23 C ultra-microcrystalline steel slab, $E_{max}$ is 9 mm, 10.4 mm, 12.8 mm or 18 mm;

for 0.23 C microcrystalline steel slab, $E_{max}$ is 25.5 mm or 80.6 mm;

the above ΔV is the ejection volume of liquid nitrogen which absorbs all the internal heat of liquid metal in small length metal slab Δm within time interval Δτ;

$\Delta V_{max}$ is the ejection volume of liquid nitrogen within time interval Δτ at a maximum liquid nitrogen ejection speed $K_{max}$=30 m/s, a thickness h=2 mm of liquid nitrogen ejection layer, a width B=1 m of metal slabs;

$\Delta Q_{2max}$ is the heat absorbed by the maximum ejection volume of liquid nitrogen $\Delta V_{max}$ to gasify completely;

$K_{max}$ is the maximum liquid nitrogen ejection speed, m/s;

K is the liquid nitrogen ejection speed, m/s;

h is the thickness of liquid nitrogen ejection layer, mm;

V is the ejection volume of liquid nitrogen, $dm^3$/min;

$V_{max}$ is the maximum ejection volume of liquid nitrogen, $dm^3$/min;

$V_g$ is the volume of nitrogen produced by the gasification of the ejection volume of liquid nitrogen V at a pressure of P=1.877 bar and a temperature t=−190° C., $dm^3$/min;

$V_{gmax}$ is the maximum volume of nitrogen produced by the gasification of the ejection volume of liquid nitrogen V at a pressure of P=1.877 bar and a temperature t=−190° C., $dm^3$/min;

when amorphous, ultra-microcrystalline, microcrystalline and fine grain metal slabs are casted with the method and equipment of R,R,C, the cooling rate $V_k$ can be determined according to the required amorphous, ultra-microcrystalline, microcrystalline and fine grain metal structures, the traction speed u of traction mechanism (6), maximum ejection volume $V_{max}$ of liquid nitrogen of liquid nitrogen ejector (5), maximum thickness of metal slabs, thickness of metal slabs E, ejection volume of liquid nitrogen V and liquid nitrogen ejection speed K can be determined by the width B, thickness E, thickness of liquid nitrogen ejection layer h, maximum liquid nitrogen ejection speed $K_{max}$, initial cooling and solidification temperature t1 and ending cooling temperature $t_2$ of required metal slabs.

4. The R,R,C method and equipment for casting amorphous, ultra-microcrystalline, microcrystalline, metal profiles according to claim 1, wherein, the temperature of the working chamber of the exhaust hood is room temperature, the pressure of the working chamber is 1 bar.

5. The R,R,C method and equipment for casting amorphous, ultra-microcrystalline, microcrystalline, metal profiles according to claim 4, wherein, the related parameters for the casting of metal profiles are calculated according to the below formulae:

1) the cooling rates $V_k$ for rapid solidification of ferrous and non-ferrous metal are as follows, for amorphous metal structure, $V_k \geq 10^{7\circ}$ C./S;

for ultra-microcrystalline metal structure, $V_k = 10^{6\circ}$ C./S~$10^{7\circ}$ C./S;

for microcrystalline metal structure, $V_k = 10^{4\circ}$ C./S~$10^{6\circ}$ C./S;

for fine grain metal structure, $V_k \leq 10^{4\circ}$ C./S;

2) the time interval Δτ is calculated with the following formula, wherein Δτ is the time interval of the solidification and cooling of liquid metal from initial rapid cooling solidification temperature $t_1$ to ending cooling temperature $t_2$ in casting small length metal slab Δm having a rectangular section with a width of B and thickness of E:

$$\Delta\tau = \Delta t / V_k \text{ S}$$

3) the calculation of heat conduction $\Delta Q_1$ for small length metal slab Δm between a cross section A and the cross section C within the time interval Δτ; the temperature of the metal on the cross section A is the initial cooling and solidification temperature $t_1$ of liquid metal, the heat conduction between cross section A and cross section C is considered as one dimensional steady heat conduction if the thickness E of slabs requires E>10Δm; according to the principle of one dimensional steady heat conduction, the heat conduction $\Delta Q_1$ for small length metal slab Δm between a cross section A and the cross section C within the time interval Δτ is calculated by the following formula, $$\Delta Q_1 = \lambda_{cp} A \Delta\tau \Delta t / \Delta m \text{ KJ}$$

4) internal heat $\Delta Q_2$ of liquid metal contained in the small length metal slab Δm is calculated with the following formulae:

for amorphous metal, $$\Delta Q_2 = BE\Delta m \rho_{cp} C_{cp} \Delta t \text{ KJ}$$

for ultra-microcrystalline, microcrystalline and fine grain metal, $$\Delta Q_2 = BE\Delta m \rho_{cp} (C_{cp}\Delta t + L) \text{ KJ}$$

5) the small length metal slab Δm being casted continuously in the time interval Δτ is calculated with the following formulae:

for amorphous metal, $$\Delta m = \sqrt{\lambda_{CP}\Delta\tau / (\rho_{CP} C_{CP})} \text{ mm}$$

for ultra-microcrystalline, microcrystalline and fine grain metal, $$\Delta m = \sqrt{\frac{\lambda_{CP}}{\rho_{CP}(C_{CP}\Delta t + L)V_K}} \cdot \Delta t \text{ mm}$$

6) the continuous casting speed u is calculated with the following formula, $$u = \Delta m / \Delta\tau \text{ m/s}$$

7) quantity of the ejection volume liquid nitrogen ΔV required to absorb the internal heat contained in liquid metal of the small length metal slab Δm within the time interval Δτ is calculated with the following formula, $$\Delta V = A\Delta Q_2 V'/r \text{ dm}^3$$

8) the ejection volume of liquid nitrogen V and the volume of nitrogen $V_g$ produced by the gasification of the ejection volume of liquid nitrogen V at a pressure of P=1.877 bar and a temperature t=−190° C. are calculated with the following formulae respectively, $$V = 60 \cdot \Delta V / \Delta\tau = 60 \cdot \Delta Q_2 V'/(r\Delta\tau) \text{ dm}^3/\text{min}$$

$$V_g = 60 \cdot \Delta Q_2 V''/(r\Delta\tau) \text{ dm}^3/\text{min}$$

9) the thickness h of liquid nitrogen ejection layer and the liquid nitrogen ejection speed K are calculated with the following formulae, $$h = A\Delta Q_2 V'/(2BKr\Delta\tau) \text{ mm}$$

Δt is the temperature difference between cross section A and cross section C, $\Delta t = t_1 - t_2$° C.;

K is the liquid nitrogen ejection speed, m/s;

$\lambda_{cp}$ is the average thermal conductivity, W/m·° C.;

A is the sectional area perpendicular to the thermal conductivity direction, $m^2$;

B is the width of the metal slabs, m;

E is the thickness of the metal slabs, m;

$\rho_{cp}$ is the average density, $g/cm^3$;

$C_{cp}$ is the average specific heat, KJ/Kg·° C.;

L is the latent heat, KJ/Kg;

V' is the volume of 1 Kg ejected liquid nitrogen at t=−190° C. and p=1.877 bar, V'=1.281 $dm^3$/Kg;

r is the latent heat at t=−190° C. and p=1.877 bar 1 Kg ejected liquid nitrogen absorbs at t=−190° C. and p=1.877 bar to gasify into nitrogen, r=190.7 KJ/Kg;

V" is the volume of nitrogen produced by the gasification of 1 Kg ejected liquid nitrogen at t=−190° C. and p=1.877 bar, V"=122.3 $dm^3$/Kg;

when amorphous, ultra-microcrystalline, microcrystalline and fine grain metal slabs are casted with R,R,C method and equipment, the cooling rate $V_k$, the traction speed u of traction mechanism (6), ejection volume of liquid nitrogen V of liquid nitrogen ejector (5) and liquid nitrogen ejection speed K can be determined according to the required amorphous, ultra-microcrystalline, microcrystalline and fine grain metal structures, and the width B, thickness E, thickness of liquid nitrogen ejection layer h, maximum liquid nitrogen ejection speed $K_{max}$, initial cooling and solidification temperature $t_1$ and ending cooling temperature $t_2$ of required metal slabs.

6. The R,R,C method and equipment for casting amorphous, ultra-microcrystalline, microcrystalline, metal profiles according to claim 5, wherein, the maximum thickness $E_{max}$ and other thickness E of metal slabs are calculated according to the below formulae:

1) calculating the values of $V_K$, Δτ, $\Delta Q_1$, $\Delta Q_2$, Δm, u and using the first six formulae in claim 2;

2) calculating $\Delta V_{max}$ $$\Delta V_{max}=2BK_{max}\Delta\tau h \text{ dm}^3$$

let $K_{max}$=30 m/s, B=1 m, h=2 mm, the value of h is fixed in the following calculation;

3) calculating $\Delta Q_{2max}$ $$\Delta_{2max}=\Delta V_{max}r/V' \text{ KJ}$$

4) calculating $E_{max}$ for amorphous steel slabs, $$E_{max}=\Delta Q_{2max}/(B\Delta m\rho_{CP}C_{CP}\Delta t) \text{ mm}$$

for ultra-microcrystalline, microcrystalline and fine grain slabs, $$E_{max}=\Delta Q_{2max}/(B\Delta m\rho_{CP}(C_{CP}\Delta t+L)) \text{ mm}$$

5) calculating $V_{max}$ and $V_{gmax}$ $$V_{max}=120BK_{max}h \text{ dm}^3/\text{min}$$

$$V_{gmax}=120BK_{max}hV''/V' \text{ dm}^3/\text{min}$$

6) calculating proportional coefficient "x"

$$x=E_{max}/E$$

7) calculating parameters of slabs with other thickness E the Δm and u of E are the same as those of $E_{max}$, $\Delta Q_2$, ΔV, V and $V_g$ are calculated with the following formulae, $$x=\Delta Q_{2max}/\Delta Q_2=\Delta V_{max}/\Delta V=V_{max}/V=V_{gmax}/V_g$$

8) calculating K when h is fixed at 2 mm, the ejection volume of liquid nitrogen drops from $V_{max}$ to V, and the liquid nitrogen ejection speed drops from $K_{max}$ to K, $$x=K_{max}/K$$

the following can be calculated in accordance with the above formulae, for 0.23 C amorphous steel slab, $E_{max}$ is 8.9 mm;

for 0.23 C ultra-microcrystalline steel slab, $E_{max}$ is 9 mm, 10.4 mm, 12.8 mm or 18 mm;

for 0.23 C microcrystalline steel slab, $E_{max}$ is 25.5 mm or 80.6 mm;

the above ΔV is the ejection volume of liquid nitrogen which absorbs all the internal heat of liquid metal in small length metal slab Δm within time interval Δτ;

$\Delta V_{max}$ is the ejection volume of liquid nitrogen within time interval Δτ at a maximum liquid nitrogen ejection speed $K_{max}$=30 m/s, a thickness h=2 mm of liquid nitrogen ejection layer, a width B=1 m of metal slabs;

$\Delta Q_{2max}$ is the heat absorbed by the maximum ejection volume of liquid nitrogen $\Delta V_{max}$ to gasify completely;

$K_{max}$ is the maximum liquid nitrogen ejection speed, m/s;

K is the liquid nitrogen ejection speed, m/s;

h is the thickness of liquid nitrogen ejection layer, mm;

V is the ejection volume of liquid nitrogen, $dm^3$/min;

$V_{max}$ is the maximum ejection volume of liquid nitrogen, $dm^3$/min;

$V_g$ is the volume of nitrogen produced by the gasification of the ejection volume of liquid nitrogen V at a pressure of P=1.877 bar and a temperature t=−190° C., $dm^3$/min;

$V_{gmax}$ is the maximum volume of nitrogen produced by the gasification of the ejection volume of liquid nitrogen V at a pressure of P=1.877 bar and a temperature t=−190° C., $dm^3$/min;

when amorphous, ultra-microcrystalline, microcrystalline and fine grain metal slabs are casted with the method and equipment of R,R,C, the cooling rate $V_k$ can be determined according to the required amorphous, ultra-microcrystalline, microcrystalline and fine grain metal structures, the traction speed u of traction mechanism (6), maximum ejection volume $V_{max}$ of liquid nitrogen of liquid nitrogen ejector (5), maximum thickness of metal slabs, thickness of metal slabs E, ejection volume of liquid nitrogen V and liquid nitrogen ejection speed K can be determined by the width B, thickness E, thickness of liquid nitrogen ejection layer h, maximum liquid nitrogen ejection speed $K_{max}$, initial cooling and solidification temperature t1 and ending cooling temperature $t_2$ of required metal slabs.

7. The R,R,C method and equipment for casting the amorphous, ultra-microcrystalline, microcrystalline, metal profiles according to claim 1, wherein, a width, length and height of the working chamber of exhaust hood are B=1.1 m, L=0.1 m and H=0.1 m respectively.

8. The R,R,C method and equipment for casting amorphous, ultra-microcrystalline, microcrystalline, metal profiles according to claim 7, wherein, the related parameters for the casting of metal profiles are calculated according to the below formulae:

1) the cooling rates $V_k$ for rapid solidification of ferrous and non-ferrous metal are as follows, for amorphous metal structure, $V_k \geq 10^{7\circ}$ C./S;

for ultra-microcrystalline metal structure, $V_k=10^{6\circ}$ C./S~$10^{7\circ}$ C./S;

for microcrystalline metal structure, $V_k=10^{4\circ}$ C./S~$10^{6\circ}$ C./S;

for fine grain metal structure, $V_k \leq 10^{4\circ}$ C./S;

2) the time interval Δτ is calculated with the following formula, wherein Δτ is the time interval of the solidification and cooling of liquid metal from initial rapid cooling solidification temperature $t_1$ to ending cooling temperature $t_2$ in casting small length metal slab Δm having a rectangular section with a width of B and thickness of E:

$$\Delta\tau=\Delta t/V_k \text{ S}$$

3) the calculation of heat conduction $\Delta Q_1$ for small length metal slab Δm between a cross section A and the cross section C within the time interval Δτ; the temperature of the metal on the cross section A is the initial cooling and solidification temperature $t_1$ of liquid metal, the heat conduction between cross section A and cross section C is considered as one dimensional steady heat conduction if the thickness E of slabs requires E>10 Δm; according to the principle of one dimensional steady heat conduction, the heat conduction $\Delta Q_1$ for small length metal slab Δm between a cross section A and the cross section C within the time interval Δτ is calculated by the following formula, $$\Delta Q_1=\lambda_{cp}A\Delta\tau\Delta t/\Delta m \text{ KJ}$$

4) internal heat $\Delta Q_2$ of liquid metal contained in the small length metal slab Δm is calculated with the following formulae:

for amorphous metal, $$\Delta Q_2=BE\Delta m\rho_{cp}C_{cp}\Delta t \text{ KJ}$$

for ultra-microcrystalline, microcrystalline and fine grain metal, $$\Delta Q_2=BE\Delta m\rho_{cp}(C_{cp}\Delta t+L) \text{ KJ}$$

5) the small length metal slab Δm being casted continuously in the time interval Δτ is calculated with the following formulae:

for amorphous metal, $$\Delta m=\sqrt{\lambda_{CP}\Delta\tau/(\rho_{CP}C_{CP})}\ \text{mm}$$

for ultra-microcrystalline, microcrystalline and fine grain metal, $$\Delta m=\sqrt{\frac{\lambda_{CP}}{\rho_{CP}(C_{CP}\Delta t+L)V_K}}\cdot\Delta t\ \text{mm}$$

6) the continuous casting speed u is calculated with the following formula, $$u=\Delta m/\Delta\tau\ \text{m/s}$$

7) quantity of the ejection volume liquid nitrogen ΔV required to absorb the internal heat contained in liquid metal of the small length metal slab Δm within the time interval Δτ is calculated with the following formula, $$\Delta V=\Delta Q_2V'/r\ \text{dm}^3$$

8) the ejection volume of liquid nitrogen V and the volume of nitrogen $V_g$ produced by the gasification of the ejection volume of liquid nitrogen V at a pressure of P=1.877 bar and a temperature t=−190° C. are calculated with the following formulae respectively, $$V=60\cdot\Delta V/\Delta\tau=60\cdot\Delta Q_2V'/(r\Delta\tau)\ \text{dm}^3/\text{min}$$

$$V_g=60\cdot\Delta Q_2V''/(r\Delta\tau)\ \text{dm}^3/\text{min}$$

9) the thickness h of liquid nitrogen ejection layer and the liquid nitrogen ejection speed K are calculated with the following formulae, $$h=\Delta Q_2V'/(2BKr\Delta\tau)\ \text{mm}$$

Δt is the temperature difference between cross section A and cross section C, $\Delta t=t_1-t_2$° C.;

K is the liquid nitrogen ejection speed, m/s;

$\lambda_{cp}$ is the average thermal conductivity, W/m·° C.;

A is the sectional area perpendicular to the thermal conductivity direction, $m^2$;

B is the width of the metal slabs, m;

E is the thickness of the metal slabs, m;

$\rho_{cp}$ is the average density, $g/cm^3$;

$C_{cp}$ is the average specific heat, KJ/Kg·° C.;

L is the latent heat, KJ/Kg;

V' is the volume of 1 Kg ejected liquid nitrogen at t=−190° C. and p=1.877 bar, V'=1.281 $dm^3$/Kg;

r is the latent heat at t=−190° C. and p=1.877 bar 1 Kg ejected liquid nitrogen absorbs at t=−190° C. and p=1.877 bar to gasify into nitrogen, r=190.7 KJ/Kg;

V" is the volume of nitrogen produced by the gasification of 1 Kg ejected liquid nitrogen at t=−190° C. and p=1.877 bar, V"=122.3 $dm^3$/Kg;

when amorphous, ultra-microcrystalline, microcrystalline and fine grain metal slabs are casted with R,R,C method and equipment, the cooling rate $V_k$, the traction speed u of traction mechanism (6), ejection volume of liquid nitrogen V of liquid nitrogen ejector (5) and liquid nitrogen ejection speed K can be determined according to the required amorphous, ultra-microcrystalline, microcrystalline and fine grain metal structures, and the width B, thickness E, thickness of liquid nitrogen ejection layer h, maximum liquid nitrogen ejection speed $K_{max}$, initial cooling and solidification temperature $t_1$ and ending cooling temperature $t_2$ of required metal slabs.

9. The R,R,C method and equipment for casting amorphous, ultra-microcrystalline, microcrystalline, metal profiles according to claim 8, wherein, the maximum thickness $E_{max}$ and other thickness E of metal slabs are calculated according to the below formulae:

1) calculating the values of $V_K$, Δτ, $\Delta Q_1$, $\Delta Q_2$, Δm, u and using the first six formulae in claim 2;

2) calculating $\Delta V_{max}$ $$\Delta V_{max}=2BK_{max}\Delta\tau h\ \text{dm}^3$$

let $K_{max}$=30 m/x, B=1 m, h=2 mm, the value of h is fixed in the following calculation 3) calculating $\Delta Q_{2max}$ $$\Delta Q_{2max}=\Delta V_{max}r/V'\text{KJ}$$

4) calculating $E_{max}$ for amorphous steel slabs, $$E_{max}=\Delta Q_{2max}/(B\Delta m\rho_{CP}C_{CP}\Delta t)\ \text{mm}$$

for ultra-microcrystalline, microcrystalline and fine grain slabs, $$E_{max}=\Delta Q_{2max}/(B\Delta m\rho_{CP}(C_{CP}\Delta t+L))\ \text{mm}$$

5) calculating $V_{max}$ and $V_{gmax}$ $$V_{max}=120BK_{max}h\ \text{dm}^3/\text{min}$$

$$V_{gmax}=120BK_{max}hV''/V'\ \text{dm}^3/\text{min}$$

6) calculating proportional coefficient "x"

$$x=E_{max}/E$$

7) calculating parameters of slabs with other thickness E the Δm and u of E are the same as those of $E_{max}$, $\Delta Q_2$, ΔV, V and $V_g$ are calculated with the following formulae, $$x=\Delta Q_{2max}/\Delta Q_2=\Delta V_{max}/\Delta V=V_{max}/V=V_{gmax}/V_g$$

8) calculating K when h is fixed at 2 mm, the ejection volume of liquid nitrogen drops from $V_{max}$ to V, and the liquid nitrogen ejection speed drops from $K_{max}$ to K, $$x=K_{max}/K$$

the following can be calculated in accordance with the above formulae, for 0.23 C amorphous steel slab, $E_{max}$ is 8.9 mm;

for 0.23 C ultra-microcrystalline steel slab, $E_{max}$ is 9 mm, 10.4 mm, 12.8 mm or 18 mm;

for 0.23 C microcrystalline steel slab, $E_{max}$ is 25.5 mm or 80.6 mm;

the above ΔV is the ejection volume of liquid nitrogen which absorbs all the internal heat of liquid metal in small length metal slab Δm within time interval Δτ;

$\Delta V_{max}$ is the ejection volume of liquid nitrogen within time interval Δτ at a maximum liquid nitrogen ejection speed $K_{max}$=30 m/s, a thickness h=2 mm of liquid nitrogen ejection layer, a width B=1 m of metal slabs;

$\Delta Q_{2max}$ is the heat absorbed by the maximum ejection volume of liquid nitrogen $\Delta V_{max}$ to gasify completely;

$K_{max}$ is the maximum liquid nitrogen ejection speed, m/s;

K is the liquid nitrogen ejection speed, m/s;

h is the thickness of liquid nitrogen ejection layer, mm;

V is the ejection volume of liquid nitrogen, $dm^3$/min;

$V_{max}$ is the maximum ejection volume of liquid nitrogen, $dm^3$/min;

$V_g$ is the volume of nitrogen produced by the gasification of the ejection volume of liquid nitrogen V at a pressure of P=1.877 bar and a temperature t=−190° C., $dm^3$/min;

$V_{gmax}$ is the maximum volume of nitrogen produced by the gasification of the ejection volume of liquid nitrogen V at a pressure of P=1.877 bar and a temperature t=−190° C., $dm^3$/min;

when amorphous, ultra-microcrystalline, microcrystalline and fine grain metal slabs are casted with the method and equipment of R,R,C, the cooling rate $V_k$ can be determined according to the required amorphous, ultra-microcrystalline, microcrystalline and fine grain metal structures, the traction speed u of traction mechanism (6), maximum ejection volume $V_{max}$ of liquid nitrogen of liquid nitrogen ejector (5), maximum thickness of metal slabs, thickness of metal slabs E, ejection volume of liquid nitrogen V and liquid nitrogen ejection speed K can be determined by the width B, thickness E, thickness of liquid nitrogen ejection layer h, maximum liquid nitrogen ejection speed $K_{max}$, initial cooling and solidification temperature t1 and ending cooling temperature $t_2$ of required metal slabs.

10. The R,R,C method and equipment for casting the amorphous, ultra-microcrystalline, microcrystalline, metal profiles according to claim 1, wherein, a thickness of liquid nitrogen ejection layer of liquid nitrogen ejector is h=2 mm.

11. The R,R,C method and equipment for casting amorphous, ultra-microcrystalline, microcrystalline, metal profiles according to claim 10, wherein, the related parameters for the casting of metal profiles are calculated according to the below formulae:

1) the cooling rates $V_k$ for rapid solidification of ferrous and non-ferrous metal are as follows, for amorphous metal structure, $V_k \geq 10^{7\circ}$ C./S;

for ultra-microcrystalline metal structure, $V_k = 10^{6\circ}$ C./S~$10^{7\circ}$ C./S;

for microcrystalline metal structure, $V_k = 10^{4\circ}$ C./S~$10^{6\circ}$ C./S;

for fine grain metal structure, $V_k \leq 10^{4\circ}$ C./S;

2) the time interval Δτ is calculated with the following formula, wherein Δτ is the time interval of the solidification and cooling of liquid metal from initial rapid cooling solidification temperature $t_1$ to ending cooling temperature $t_2$ in casting small length metal slab Δm having a rectangular section with a width of B and thickness of E:

$$\Delta\tau = \Delta t / V_k \text{ S}$$

3) the calculation of heat conduction $\Delta Q_1$ for small length metal slab Δm between a cross section A and the cross section C within the time interval Δτ; the temperature of the metal on the cross section A is the initial cooling and solidification temperature $t_1$ of liquid metal, the heat conduction between cross section A and cross section C is considered as one dimensional steady heat conduction if the thickness E of slabs requires E>10 Δm; according to the principle of one dimensional steady heat conduction, the heat conduction $\Delta Q_1$ for small length metal slab Δm between a cross section A and the cross section C within the time interval Δτ is calculated by the following formula, $$\Delta Q_1 = \lambda_{cp} A \Delta\tau \Delta t / \Delta m \text{ KJ}$$

4) internal heat $\Delta Q_2$ of liquid metal contained in the small length metal slab Δm is calculated with the following formulae:

for amorphous metal, $$\Delta Q_2 = BE\Delta m \rho_{cp} C_{cp} \Delta t \text{ KJ}$$

for ultra-microcrystalline, microcrystalline and fine grain metal, $$\Delta Q_2 = BE\Delta m \rho_{cp} (C_{cp}\Delta t + L) \text{ KJ}$$

5) the small length metal slab Δm being casted continuously in the time interval Δτ is calculated with the following formulae:

for amorphous metal, $$\Delta m = \sqrt{\lambda_{CP}\Delta\tau / (\rho_{CP} C_{CP})} \text{ mm}$$

for ultra-microcrystalline, microcrystalline and fine grain metal, $$\Delta m = \sqrt{\frac{\lambda_{CP}}{\rho_{CP}(C_{CP}\Delta t + L)V_K}} \cdot \Delta t \text{ mm}$$

6) the continuous casting speed u is calculated with the following formula, $$u = \Delta m / \Delta\tau \text{ m/s}$$

7) quantity of the ejection volume liquid nitrogen ΔV required to absorb the internal heat contained in liquid metal of the small length metal slab Δm within the time interval Δτ is calculated with the following formula, $$\Delta V = \Delta Q_2 V'/r \text{ dm}^3$$

8) the ejection volume of liquid nitrogen V and the volume of nitrogen $V_g$ produced by the gasification of the ejection volume of liquid nitrogen V at a pressure of P=1.877 bar and a temperature t=−190° C. are calculated with the following formulae respectively, $$V = 60 \cdot \Delta V / \Delta\tau = 60 \cdot \Delta Q_2 V'/(r\Delta\tau) \text{ dm}^3/\text{min}$$

$$V_g = 60 \cdot \Delta Q_2 V''/(r\Delta\tau) \text{ dm}^3/\text{min}$$

9) the thickness h of liquid nitrogen ejection layer and the liquid nitrogen ejection speed K are calculated with the following formulae, $$h = \Delta Q_2 V'/(2BKr\Delta\tau) \text{ mm}$$

Δt is the temperature difference between cross section A and cross section C, $\Delta t = t_1 - t_2$° C.;

K is the liquid nitrogen ejection speed, m/s;

$\lambda_{cp}$ is the average thermal conductivity, W/m·° C.;

A is the sectional area perpendicular to the thermal conductivity direction, $m^2$;

B is the width of the metal slabs, m;

E is the thickness of the metal slabs, m;

$\rho_{cp}$ is the average density, $g/cm^3$;

$C_{cp}$ is the average specific heat, KJ/Kg·° C.;

L is the latent heat, KJ/Kg;

V' is the volume of 1 Kg ejected liquid nitrogen at t=−190° C. and p=1.877 bar, V'=1.281 $dm^3$/Kg;

r is the latent heat at t=−190° C. and p=1.877 bar 1 Kg ejected liquid nitrogen absorbs at t=−190° C. and p=1.877 bar to gasify into nitrogen, r=190.7 KJ/Kg;

V" is the volume of nitrogen produced by the gasification of 1 Kg ejected liquid nitrogen at t=−190° C. and p=1.877 bar, V"=122.3 $dm^3$/Kg;

when amorphous, ultra-microcrystalline, microcrystalline and fine grain metal slabs are casted with R,R,C method and equipment, the cooling rate $V_k$, the traction speed u of traction mechanism (6), ejection volume of liquid nitrogen V of liquid nitrogen ejector (5) and liquid nitrogen ejection speed K can be determined according to the required amorphous, ultra-microcrystalline, microcrystalline and fine grain metal structures, and the width B, thickness E, thickness of liquid nitrogen ejection layer h, maximum liquid nitrogen ejection speed $K_{max}$, initial cooling and solidification temperature $t_1$ and ending cooling temperature $t_2$ of required metal slabs.

12. The R,R,C method and equipment for casting amorphous, ultra-microcrystalline, microcrystalline, metal profiles according to claim 11, wherein, the maximum thickness $E_{max}$ and other thickness E of metal slabs are calculated according to the below formulae:

1) calculating the values of $V_K$, $\Delta\tau$, $\Delta Q_1$, $\Delta Q_2$, $\Delta m$, u and using the first six formulae in claim 2;

2) calculating $\Delta V_{max}$ $$\Delta V_{max}=2BK_{max}\Delta\tau h \text{ dm}^3$$

let $K_{max}$=30 m/s, B=1 m, h=2 mm, the value of h is fixed in the following calculation;

3) calculating $\Delta Q_{2max}$ $$\Delta Q_{2max}=\Delta V_{max}r/V' \text{ KJ}$$

4) calculating $E_{max}$ for amorphous steel slabs, $$E_{max}=\Delta Q_{2max}/(B\Delta m\rho_{CP}C_{CP}\Delta t) \text{ mm}$$

for ultra-microcrystalline, microcrystalline and fine grain slabs, $$E_{max}=\Delta Q_{2max}/(B\Delta m\rho_{CP}(C_{CP}\Delta t+L)) \text{ mm}$$

5) calculating $V_{max}$ and $V_{gmax}$ $$V_{max}=120BK_{max}h \text{ dm}^3/\text{min}$$

$$V_{gmax}=120BK_{max}hV''/V' \text{ dm}^3/\text{min}$$

6) calculating proportional coefficient "x"

$$x=E_{max}/E$$

7) calculating parameters of slabs with other thickness E the $\Delta m$ and u of E are the same as those of $E_{max}$, $\Delta Q_2$, $\Delta V$, V and $V_g$ are calculated with the following formulae, $$x=\Delta Q_{2max}/\Delta Q_2=\Delta V_{max}/\Delta V=V_{max}/V=V_{gmax}/V_g$$

8) calculating K when h is fixed at 2 mm, the ejection volume of liquid nitrogen drops from $V_{max}$ to V, and the liquid nitrogen ejection speed drops from $K_{max}$ to K, $$x=K_{max}/K$$

the following can be calculated in accordance with the above formulae, for 0.23 C amorphous steel slab, $E_{max}$ is 8.9 mm;

for 0.23 C ultra-microcrystalline steel slab, $E_{max}$ is 9 mm, 10.4 mm, 12.8 mm or 18 mm;

for 0.23 C microcrystalline steel slab, $E_{max}$ is 25.5 mm or 80.6 mm;

the above $\Delta V$ is the ejection volume of liquid nitrogen which absorbs all the internal heat of liquid metal in small length metal slab $\Delta m$ within time interval $\Delta\tau$;

$\Delta V_{max}$ is the ejection volume of liquid nitrogen within time interval $\Delta\tau$ at a maximum liquid nitrogen ejection speed $K_{max}$=30 m/s, a thickness h=2 mm of liquid nitrogen ejection layer, a width B=1 m of metal slabs;

$\Delta Q_{2max}$ is the heat absorbed by the maximum ejection volume of liquid nitrogen $\Delta V_{max}$ to gasify completely;

$K_{max}$ is the maximum liquid nitrogen ejection speed, m/s;

K is the liquid nitrogen ejection speed, m/s;

h is the thickness of liquid nitrogen ejection layer, mm;

V is the ejection volume of liquid nitrogen, $dm^3$/min;

$V_{max}$ is the maximum ejection volume of liquid nitrogen, $dm^3$/min;

$V_g$ is the volume of nitrogen produced by the gasification of the ejection volume of liquid nitrogen V at a pressure of P=1.877 bar and a temperature t=−190° C., $dm^3$/min;

$V_{gmax}$ is the maximum volume of nitrogen produced by the gasification of the ejection volume of liquid nitrogen V at a pressure of P=1.877 bar and a temperature t=−190° C., $dm^3$/min;

when amorphous, ultra-microcrystalline, microcrystalline and fine grain metal slabs are casted with the method and equipment of R,R,C, the cooling rate $V_k$ can be determined according to the required amorphous, ultra-microcrystalline, microcrystalline and fine grain metal structures, the traction speed u of traction mechanism (6), maximum ejection volume $V_{max}$ of liquid nitrogen of liquid nitrogen ejector (5), maximum thickness of metal slabs, thickness of metal slabs E, ejection volume of liquid nitrogen V and liquid nitrogen ejection speed K can be determined by the width B, thickness E, thickness of liquid nitrogen ejection layer h, maximum liquid nitrogen ejection speed $K_{max}$, initial cooling and solidification temperature t1 and ending cooling temperature $t_2$ of required metal slabs.

13. The R,R,C method and equipment for casting the amorphous, ultra-microcrystalline, microcrystalline, metal profiles according to claim 1, wherein, the metal profiles are 0.23 C carbon steel slabs, wherein the initial cooling and solidification temperature $t_1$ is 1550° C. of the liquid metal in small length metal slab $\Delta m$ of 0.23 C carbon steel slabs.

14. The R,R,C method and equipment for casting amorphous, ultra-microcrystalline, microcrystalline, metal profiles according to claim 13, wherein, the related parameters for the casting of metal profiles are calculated according to the below formulae:

1) the cooling rates $V_k$ for rapid solidification of ferrous and non-ferrous metal are as follows, for amorphous metal structure, $V_k \geq 10^{7\circ}$ C./S;

for ultra-microcrystalline metal structure, $V_k=10^{6\circ}$ C./S~$10^{7\circ}$ C./S;

for microcrystalline metal structure, $V_k=10^{4\circ}$ C./S~$10^{6\circ}$ C./S;

for fine grain metal structure, $V_k \leq 10^{4\circ}$ C./S;

2) the time interval $\Delta\tau$ is calculated with the following formula, wherein $\Delta\tau$ is the time interval of the solidification and cooling of liquid metal from initial rapid cooling solidification temperature $t_1$ to ending cooling temperature $t_2$ in casting small length metal slab $\Delta m$ having a rectangular section with a width of B and thickness of E:

$$\Delta t=\Delta t/V_k \text{ S}$$

3) the calculation of heat conduction $\Delta Q_1$ for small length metal slab $\Delta m$ between a cross section A and the cross section C within the time interval $\Delta\tau$; the temperature of the metal on the cross section A is the initial cooling and solidification temperature $t_1$ of liquid metal, the heat conduction between cross section A and cross section C is considered as one dimensional steady heat conduction if the thickness E of slabs requires E>10$\Delta m$; according to the principle of one dimensional steady heat conduction, the heat conduction $\Delta Q_1$ for small length metal slab $\Delta m$ between a cross section A and the cross section C within the time interval $\Delta\tau$ is calculated by the following formula, $$\Delta Q_1=\lambda_{cp}A\Delta\tau\Delta t/\Delta m \text{ KJ}$$

4) internal heat $\Delta Q_2$ of liquid metal contained in the small length metal slab $\Delta m$ is calculated with the following formulae:

for amorphous metal, $$\Delta Q_2=BE\Delta m\rho_{cp}C_{cp}\Delta t \text{ KJ}$$

for ultra-microcrystalline, microcrystalline and fine grain metal, $$\Delta Q_2=BE\Delta m\rho_{cp}(C_{cp}\Delta t+L) \text{ KJ}$$

5) the small length metal slab $\Delta m$ being casted continuously in the time interval $\Delta\tau$ is calculated with the following formulae:

for amorphous metal, $$\Delta m=\sqrt{\lambda_{CP}\Delta\tau/(\rho_{CP}C_{CP})} \text{ mm}$$

for ultra-microcrystalline, microcrystalline and fine grain metal, $$\Delta m=\sqrt{\frac{\lambda_{CP}}{\rho_{CP}(C_{CP}\Delta t+L)V_K}}\cdot\Delta t \text{ mm}$$

6) the continuous casting speed u is calculated with the following formula, $$u=\Delta m/\Delta\tau \text{ m/s}$$

7) quantity of the ejection volume liquid nitrogen $\Delta V$ required to absorb the internal heat contained in liquid metal of the small length metal slab $\Delta m$ within the time interval $\Delta\tau$ is calculated with the following formula, $$\Delta V=\Delta Q_2V'/r \text{ dm}^3$$

8) the ejection volume of liquid nitrogen V and the volume of nitrogen $V_g$ produced by the gasification of the ejection volume of liquid nitrogen V at a pressure of P=1.877 bar and a temperature t=−190° C. are calculated with the following formulae respectively, $$V=60\cdot\Delta V/\Delta\tau=60\cdot\Delta Q_2V'/(r\Delta\tau) \text{ dm}^3/\text{min}$$

$$V_g=60\cdot\Delta Q_2V''/(r\Delta\tau) \text{ dm}^3/\text{min}$$

9) the thickness h of liquid nitrogen ejection layer and the liquid nitrogen ejection speed K are calculated with the following formulae, $$h=\Delta Q_2V'/(2BKr\Delta\tau) \text{ mm}$$

$\Delta t$ is the temperature difference between cross section A and cross section C, $\Delta t=t_1-t_2$° C.;

K is the liquid nitrogen ejection speed, m/s;

$\lambda_{cp}$ is the average thermal conductivity, W/m·° C.;

A is the sectional area perpendicular to the thermal conductivity direction, $m^2$;

B is the width of the metal slabs, m;

E is the thickness of the metal slabs, m;

$\rho_{cp}$ is the average density, $g/cm^3$;

$C_{cp}$ is the average specific heat, KJ/Kg·° C.;

L is the latent heat, KJ/Kg;

V' is the volume of 1 Kg ejected liquid nitrogen at t=−190° C. and p=1.877 bar, V'=1.281 $dm^3$/Kg;

r is the latent heat at t=−190° C. and p=1.877 bar 1 Kg ejected liquid nitrogen absorbs at t=−190° C. and p=1.877 bar to gasify into nitrogen, r=190.7 KJ/Kg;

V" is the volume of nitrogen produced by the gasification of 1 Kg ejected liquid nitrogen at t=−190° C. and p=1.877 bar, V"=122.3 $dm^3$/Kg;

when amorphous, ultra-microcrystalline, microcrystalline and fine grain metal slabs are casted with R,R,C method and equipment, the cooling rate $V_k$, the traction speed u of traction mechanism (6), ejection volume of liquid nitrogen V of liquid nitrogen ejector (5) and liquid nitrogen ejection speed K can be determined according to the required amorphous, ultra-microcrystalline, microcrystalline and fine grain metal structures, and the width B, thickness E, thickness of liquid nitrogen ejection layer h, maximum liquid nitrogen ejection speed $K_{max}$, initial cooling and solidification temperature $t_1$ and ending cooling temperature $t_2$ of required metal slabs.

15. The R,R,C method and equipment for casting amorphous, ultra-microcrystalline, microcrystalline, metal profiles according to claim 14, wherein, the maximum thickness $E_{max}$ and other thickness E of metal slabs are calculated according to the below formulae:

1) calculating the values of $V_K$, $\Delta\tau$, $\Delta Q_1$, $\Delta Q_2$, $\Delta m$, u and using the first six formulae in claim 2;

2) calculating $\Delta V_{max}$ $$\Delta V_{max}=2BK_{max}\Delta\tau h \text{ dm}^3$$

let $K_{max}$=30 m/s, B=1 m, h=2 mm, the value of h is fixed in the following calculation;

3) calculating $\Delta Q_{2max}$ $$\Delta Q_{2max}=\Delta V_{max}r/V' \text{ KJ}$$

4) calculating $E_{max}$ for amorphous steel slabs, $$E_{max}=\Delta Q_{2max}/(B\Delta m\rho_{CP}C_{CP}\Delta t) \text{ mm}$$

for ultra-microcrystalline, microcrystalline and fine grain slabs, $$E_{max}=\Delta Q_{2max}/(B\Delta m\rho_{CP}(C_{CP}\Delta t+L)) \text{ mm}$$

5) calculating $V_{max}$ and $V_{gmax}$ $$V_{max}=120BK_{max}h \text{ dm}^3/\text{min}$$

$$V_{gmax}=120BK_{max}hV''/V' \text{ dm}^3/\text{min}$$

6) calculating proportional coefficient "x"

$$x=E_{max}/E$$

7) calculating parameters of slabs with other thickness E the $\Delta m$ and u of E are the same as those of $E_{max}$, $\Delta Q_2$, $\Delta V$, V and $V_g$ are calculated with the following formulae, $$x=\Delta Q_{2max}/\Delta Q_2=\Delta V_{max}/\Delta V=V_{max}/V=V_{gmax}/V_g$$

8) calculating K when h is fixed at 2 mm, the ejection volume of liquid nitrogen drops from $V_{max}$, to V, and the liquid nitrogen ejection speed drops from $K_{max}$ to K, $$x=K_{max}/K$$

the following can be calculated in accordance with the above formulae, for 0.23 C amorphous steel slab, $E_{max}$ is 8.9 mm;

for 0.23 C ultra-microcrystalline steel slab, $E_{max}$ is 9 mm, 10.4 mm, 12.8 mm or 18 mm;

for 0.23 C microcrystalline steel slab, $E_{max}$ is 25.5 mm or 80.6 mm;

the above $\Delta V$ is the ejection volume of liquid nitrogen which absorbs all the internal heat of liquid metal in small length metal slab $\Delta m$ within time interval $\Delta\tau$;

$\Delta V_{max}$ is the ejection volume of liquid nitrogen within time interval $\Delta\tau$ at a maximum liquid nitrogen ejection speed $K_{max}$=30 m/s, a thickness h=2 mm of liquid nitrogen ejection layer, a width B=1 m of metal slabs;

$\Delta Q_{2max}$ is the heat absorbed by the maximum ejection volume of liquid nitrogen $\Delta V_{max}$ to gasify completely;

$K_{max}$ is the maximum liquid nitrogen ejection speed, m/s;

K is the liquid nitrogen ejection speed, m/s;

h is the thickness of liquid nitrogen ejection layer, mm;

V is the ejection volume of liquid nitrogen, $dm^3$/min;

$V_{max}$ is the maximum ejection volume of liquid nitrogen, $dm^3$/min;

$V_g$ is the volume of nitrogen produced by the gasification of the ejection volume of liquid nitrogen V at a pressure of P=1.877 bar and a temperature t=−190° C., $dm^3$/min;

$V_{gmax}$ is the maximum volume of nitrogen produced by the gasification of the ejection volume of liquid nitrogen V at a pressure of P=1.877 bar and a temperature t=−190° C., $dm^3$/min;

when amorphous, ultra-microcrystalline, microcrystalline and fine grain metal slabs are casted with the method and equipment of R,R,C, the cooling rate $V_k$ can be determined according to the required amorphous, ultra-microcrystalline, microcrystalline and fine grain metal structures, the traction speed u of traction mechanism (6), maximum ejection volume $V_{max}$ of liquid nitrogen of liquid nitrogen ejector (5), maximum thickness of metal slabs, thickness of metal slabs E, ejection volume of liquid nitrogen V and liquid nitrogen ejection speed K can be determined by the width B, thickness E, thickness of liquid nitrogen ejection layer h, maximum liquid nitrogen ejection speed $K_{max}$, initial cooling and solidification temperature t1 and ending cooling temperature $t_2$ of required metal slabs.

16. The R,R,C method and equipment for casting amorphous, ultra-microcrystalline, microcrystalline, metal profiles according to claim 1, wherein, the metal profiles are 0.23 C carbon steel slabs, wherein the ending cooling temperature $t_2$ is −190° C. to 500° C. of the liquid metal in small length metal slab $\Delta m$ of 0.23 C carbon steel slabs.

17. The R,R,C method and equipment for casting amorphous, ultra-microcrystalline, microcrystalline, metal profiles according to claim 16, wherein, the related parameters for the casting of metal profiles are calculated according to the below formulae:

1) the cooling rates $V_k$ for rapid solidification of ferrous and non-ferrous metal are as follows, for amorphous metal structure, $V_k \geq 10^{7\circ}$ C./S;

for ultra-microcrystalline metal structure, $V_k = 10^{6\circ}$ C./S~$10^{7\circ}$ C./S;

for microcrystalline metal structure, $V_k = 10^{4\circ}$ C./S~$10^{6\circ}$ C./S;

for fine grain metal structure, $V_k \leq 10^{4\circ}$ C./S;

2) the time interval $\Delta\tau$ is calculated with the following formula, wherein $\Delta\tau$ is the time interval of the solidification and cooling of liquid metal from initial rapid cooling solidification temperature $t_1$ to ending cooling temperature $t_2$ in casting small length metal slab $\Delta m$ having a rectangular section with a width of B and thickness of E:

$$\Delta\tau = \Delta t / V_k \text{ S}$$

3) the calculation of heat conduction $\Delta Q_1$ for small length metal slab $\Delta m$ between a cross section A and the cross section C within the time interval $\Delta\tau$; the temperature of the metal on the cross section A is the initial cooling and solidification temperature $t_1$ of liquid metal, the heat conduction between cross section A and cross section C is considered as one dimensional steady heat conduction if the thickness E of slabs requires E>10$\Delta m$; according to the principle of one dimensional steady heat conduction, the heat conduction $\Delta Q_1$ for small length metal slab $\Delta m$ between a cross section A and the cross section C within the time interval $\Delta\tau$ is calculated by the following formula, $$\Delta Q_1 = \lambda_{cp} A \Delta\tau \Delta t / \Delta m \text{ KJ}$$

4) internal heat $\Delta Q_2$ of liquid metal contained in the small length metal slab $\Delta m$ is calculated with the following formulae:

for amorphous metal, $$\Delta Q_2 = BE\Delta m \rho_{cp} C_{cp} \Delta t \text{ KJ}$$

for ultra-microcrystalline, microcrystalline and fine grain metal, $$\Delta Q_2 = BE\Delta m \rho_{cp} (C_{cp}\Delta t + L) \text{ KJ}$$

5) the small length metal slab $\Delta m$ being casted continuously in the time interval $\Delta\tau$ is calculated with the following formulae:

for amorphous metal, $$\Delta m = \sqrt{\lambda_{CP}\Delta\tau / (\rho_{CP} C_{CP})} \text{ mm}$$

for ultra-microcrystalline, microcrystalline and fine grain metal, $$\Delta m = \sqrt{\frac{\lambda_{CP}}{\rho_{CP}(C_{CP}\Delta t + L)V_K}} \cdot \Delta t \text{ mm}$$

6) the continuous casting speed u is calculated with the following formula, $$u = \Delta m / \Delta\tau \text{ m/s}$$

7) quantity of the ejection volume liquid nitrogen $\Delta V$ required to absorb the internal heat contained in liquid metal of the small length metal slab $\Delta m$ within the time interval $\Delta\tau$ is calculated with the following formula, $$\Delta V = \Delta Q_2 V'/r \text{ dm}^3$$

8) the ejection volume of liquid nitrogen V and the volume of nitrogen $V_g$ produced by the gasification of the ejection volume of liquid nitrogen V at a pressure of P=1.877 bar and a temperature t=−190° C. are calculated with the following formulae respectively, $$V = 60 \cdot \Delta V / \Delta\tau = 60 \cdot \Delta Q_2 V'/(r\Delta\tau) \text{ dm}^3/\text{min}$$

$$V_g = 60 \cdot \Delta Q_2 V''/(r\Delta\tau) \text{ dm}^3/\text{min}$$

9) the thickness h of liquid nitrogen ejection layer and the liquid nitrogen ejection speed K are calculated with the following formulae, $$h = \Delta Q_2 V'/(2BKr\Delta\tau) \text{ mm}$$

$\Delta t$ is the temperature difference between cross section A and cross section C, $\Delta t = t_1 - t_2$° C.;

K is the liquid nitrogen ejection speed, m/s;

$\lambda_{cp}$ is the average thermal conductivity, W/m·° C.;

A is the sectional area perpendicular to the thermal conductivity direction, $m^2$;

B is the width of the metal slabs, m;

E is the thickness of the metal slabs, m;

$\rho_{cp}$ is the average density, g/cm$^3$;

$C_{cp}$ is the average specific heat, KJ/Kg·° C.;

L is the latent heat, KJ/Kg;

V' is the volume of 1 Kg ejected liquid nitrogen at t=−190° C. and p=1.877 bar, V'=1.281 dm$^3$/Kg;

r is the latent heat at t=−190° C. and p=1.877 bar 1 Kg ejected liquid nitrogen absorbs at t=−190° C. and p=1.877 bar to gasify into nitrogen, r=190.7 KJ/Kg;

V" is the volume of nitrogen produced by the gasification of 1 Kg ejected liquid nitrogen at t=−190° C. and p=1.877 bar, V"=122.3 dm$^3$/Kg;

when amorphous, ultra-microcrystalline, microcrystalline and fine grain metal slabs are casted with R,R,C method and equipment, the cooling rate $V_k$, the traction speed u of traction mechanism (6), ejection volume of liquid nitrogen V of liquid nitrogen ejector (5) and liquid nitrogen ejection speed K can be determined according to the required amorphous, ultra-microcrystalline, microcrystalline and fine grain metal structures, and the width B, thickness E, thickness of liquid nitrogen ejection layer h, maximum liquid nitrogen ejection speed $K_{max}$, initial cooling and solidification temperature $t_1$ and ending cooling temperature $t_2$ of required metal slabs.

18. The R,R,C method and equipment for casting amorphous, ultra-microcrystalline, microcrystalline, metal profiles according to claim 17, wherein, the maximum thickness $E_{max}$ and other thickness E of metal slabs are calculated according to the below formulae:

1) calculating the values of $V_K$, Δτ, $\Delta Q_1$, $\Delta Q_2$, Δm, u and using the first six formulae in claim 2;

2) calculating $\Delta V_{max}$ $$\Delta V_{max}=2BK_{max}\Delta\tau h \text{ dm}^3$$

let $K_{max}$=30 m/s, B=1 m, h=2 mm, the value of h is fixed in the following calculation;

3) calculating $\Delta Q_{2max}$ $$\Delta Q_{2max}=\Delta V_{max}r/V' \text{ KJ}$$

4) calculating $E_{max}$ for amorphous steel slabs, $$E_{max}=\Delta Q_{2max}/(B\Delta m\rho_{CP}C_{CP}\Delta t) \text{ mm}$$

for ultra-microcrystalline, microcrystalline and fine grain slabs, $$E_{max}=\Delta Q_{2max}/(B\Delta m\rho_{CP}(C_{CP}\Delta t+L)) \text{ mm}$$

5) calculating $V_{max}$ and $V_{gmax}$ $$V_{max}=120BK_{max}h \text{ dm}^3/\text{min}$$

$$V_{gmax}=120BK_{max}hV''/V' \text{ dm}^3/\text{min}$$

6) calculating proportional coefficient "x"

$$x=E_{max}/E$$

7) calculating parameters of slabs with other thickness E the Δm and u of E are the same as those of $E_{max}$, $\Delta Q_2$, ΔV, V and $V_g$ are calculated with the following formulae, $$x=\Delta Q_{2max}/\Delta Q_2=\Delta V_{max}/\Delta V=V_{max}/V=V_{gmax}/V_g$$

8) calculating K when h is fixed at 2 mm, the ejection volume of liquid nitrogen drops from $V_{max}$ to V, and the liquid nitrogen ejection speed drops from $K_{max}$ to K, $$x=K_{max}/K$$

the following can be calculated in accordance with the above formulae, for 0.23 C amorphous steel slab, $E_{max}$ is 8.9 mm;

for 0.23 C ultra-microcrystalline steel slab, $E_{max}$ is 9 mm, 10.4 mm, 12.8 mm or 18 mm;

for 0.23 C microcrystalline steel slab, $E_{max}$ is 25.5 mm or 80.6 mm;

the above ΔV is the ejection volume of liquid nitrogen which absorbs all the internal heat of liquid metal in small length metal slab Δm within time interval Δτ;

$\Delta V_{max}$ is the ejection volume of liquid nitrogen within time interval Δτ at a maximum liquid nitrogen ejection speed $K_{max}$=30 m/s, a thickness h=2 mm of liquid nitrogen ejection layer, a width B=1 m of metal slabs;

$\Delta Q_{2max}$ is the heat absorbed by the maximum ejection volume of liquid nitrogen $\Delta V_{max}$ to gasify completely;

$K_{max}$ is the maximum liquid nitrogen ejection speed, m/s;

K is the liquid nitrogen ejection speed, m/s;

h is the thickness of liquid nitrogen ejection layer, mm;

V is the ejection volume of liquid nitrogen, dm$^3$/min;

$V_{max}$ is the maximum ejection volume of liquid nitrogen, dm$^3$/min;

$V_g$ is the volume of nitrogen produced by the gasification of the ejection volume of liquid nitrogen V at a pressure of P=1.877 bar and a temperature t=−190° C., dm$^3$/min;

$V_{gmax}$ is the maximum volume of nitrogen produced by the gasification of the ejection volume of liquid nitrogen V at a pressure of P=1.877 bar and a temperature t=−190° C., dm$^3$/min;

when amorphous, ultra-microcrystalline, microcrystalline and fine grain metal slabs are casted with the method and equipment of R,R,C, the cooling rate $V_k$ can be determined according to the required amorphous, ultra-microcrystalline, microcrystalline and fine grain metal structures, the traction speed u of traction mechanism (6), maximum ejection volume $V_{max}$ of liquid nitrogen of liquid nitrogen ejector (5), maximum thickness of metal slabs, thickness of metal slabs E, ejection volume of liquid nitrogen V and liquid nitrogen ejection speed K can be determined by the width B, thickness E, thickness of liquid nitrogen ejection layer h, maximum liquid nitrogen ejection speed $K_{max}$, initial cooling and solidification temperature t1 and ending cooling temperature $t_2$ of required metal slabs.

* * * * *